US005589314A

United States Patent [19]

Etoh et al.

[11] Patent Number: 5,589,314

[45] Date of Patent: Dec. 31, 1996

[54] IMAGE FORMING METHOD USING AN IMIDAZOLE-PERYLENE ELECTROPHOTOGRAPHIC PHOTORECEPTOR

[75] Inventors: Yoshihiko Etoh; Takeo Oshiba; Asao Matsushima, all of Hachioji; Hirofumi Hayata, Hino; Tomoo Sakimura, Hino; Tomoko Suzuki, Hino; Akira Kinoshita, Hino, all of Japan

[73] Assignee: Konica Corporation, Japan

[21] Appl. No.: 490,781

[22] Filed: Jun. 15, 1995

[30] Foreign Application Priority Data

Jun. 22, 1994 [JP] Japan ..... 6-140363

[51] Int. Cl.[6] ..... G03G 13/04; G03G 13/22

[52] U.S. Cl. ..... 430/126; 430/58; 430/59; 430/31

[58] Field of Search ..... 430/31, 58, 126

[56] References Cited

U.S. PATENT DOCUMENTS

| | | | |
|---|---|---|---|
| 4,156,757 | 5/1979 | Graser et al. | 430/56 X |
| 4,792,508 | 12/1988 | Kazmaier et al. | 430/59 |
| 5,320,921 | 6/1994 | Oshiba et al. | 430/58 |
| 5,434,027 | 7/1995 | Oshiba et al. | 430/126 X |

*Primary Examiner*—Roland Martin

*Attorney, Agent, or Firm*—Jordan B. Bierman; Bierman and Muserlian

[57] ABSTRACT

Disclosed is an image forming method using an electrophotographic photoreceptor comprising the steps of:

(1) charging the electrophotographic photoreceptor, wherein said electrophotographic photoreceptor comprising a conductive support and provided thereon, a carrier generation layer and a carrier transportation layer, said carrier generation layer comprising a carrier generation material represented by formula 1 or 2 and having X-ray diffraction pattern having peaks at 6.3°±0.2°, 12.4°±0.2°, 25.3°±0.2° and 27.1°±0.2° in Bragg angle (2θ) when using Cu-Kα ray as a X-ray radiation source in which said peak of 12.4°±0.2° has a maximum intensity and has a half width of 0.65° or more; no peak being present at 11.5°±0.2°, (2) imagewise exposing the charged photoreceptor for an exposure time of $1\times10^{-4}$ to $3\times10^{-2}$ seconds, (3) developing the imagewise exposed photoreceptor to form an image, and (4) transferring the formed image to an image receiving material:

formula 1 formula 2

6 Claims, 5 Drawing Sheets

IMAGE FORMING METHOD USING AN IMIDAZOLE-PERYLENE ELECTROPHOTOGRAPHIC PHOTORECEPTOR

FIELD OF THE INVENTION

The present invention relates to an image forming method by which a high speed copying operation is carried out using a specific organic photoreceptor.

BACKGROUND OF THE INVENTION

In an electrophotographic copier to which the Calson Method is applied, image formation is conducted as follows. After a photoreceptor has been uniformly charged, the photoreceptor is subjected to image exposure so that the electric charge on the photoreceptor is erased image-wise and an electrostatic latent image is formed. This electrostatic latent image is developed by toner, and the obtained toner image is transferred and fixed onto a transfer sheet such as a sheet of paper.

After the toner image has been transferred onto the transfer sheet, residual toner is removed and further static electricity is discharged from the photoreceptor surface. In this way, the photoreceptor surface is purified. Accordingly, the photoreceptor for electrophotographic use must be provided with an appropriate charging characteristic and high sensitivity, and further dark decay of the photoreceptor must be low. Furthermore, the photoreceptor is required to have physical properties such as an anti-rubbing property, anti-abrasion property and anti-damage property since it is repeatedly used. Besides it is required that the photoreceptor is resistant to ozone generated in the process of corona discharge and also resistant to ultraviolet rays incident on the photoreceptor in the process of exposure.

Since copiers have come into wide use recently, there is a demand for a high speed type copier capable of processing a large number of copies at high speed and a compact type copier for office or family use.

In order to meet the demand of users, it is necessary to develop a highly sensitive and durable photoreceptor.

As an example of the highly sensitive and durable photoreceptor, an inorganic photoreceptor is known, the photosensitive layer of which primarily contains an inorganic photoconductive substance of selenium type. However, the inorganic photoconductive substance of selenium type is harmful to the human body. Besides, it is difficult of machine the inorganic photoconductive substance of selenium type, so that the productivity is not high and further the moisture-resistant property is low.

Recently, research and development are actively performed so as to provide an organic photoreceptor having high productivity and moisture-resistant property and causing no public pollution. Attention is given to functionary separated multi layered type photoreceptor in which a function of charge generation and a function of charge transport are performed by different substances, and a substance to perform each function is selected from a wide range in accordance with the desired characteristics.

In the process of research and development, many results are proposed with respect to the charge generation and charge transport substances having charge generation and charge transport functions.

For example, an azo pigment effectively used as a charge generation substance is disclosed in Japanese Patent Publication Open to Public Inspection No. 222152/1983, and a styryl compound effectively used as a charge transport substance is disclosed in Japanese Patent Publication Open to Public Inspection No. 149652/1988.

As described above, an organic photoreceptor, the sensitivity and durability of which are equal or superior to the selenium photoreceptor, has been developed and put into practical use.

In accordance with the enhancement of sensitivity and durability of the organic photoreceptor, there is a demand for extending the use of the organic photoreceptor from a low or medium speed machine, the processing speed of which is not more than 40 sheets/min, to a high speed machine, the processing speed of which is not less than 50 sheets/min when the sheets of size A4 are processed. In this case, the high speed machine includes a slit exposure type high speed copier in which a photoreceptor drum is used, and a flash exposure type high speed copier in which a photoreceptor belt is used.

However, compared with the low and medium speed machines described above, the high speed machine must be operated in a severe image forming condition. Especially, it is necessary to overcome the following problems relating to image exposure.

In the case of copying at high speed, a surface of the photoreceptor is exposed to light of high intensity over a short period of time. Accordingly, due to the reciprocity law failure, various problems are caused such as a deterioration of the sensitivity, increase of the residual potential and a defective formation of the latent image. Therefore, fog is caused and the formed image is blurred.

When copying is conducted in the flash exposure type copier at high speed, it is necessary to increase the moving speed of the photoreceptor. Accordingly, time of exposure of the photoreceptor conducted by the slit becomes short, and the same problems as those of flash exposure are caused. In order to make the copier compact, a diameter of the photoreceptor drum is reduced. Therefore, in order to obtain an image having a predetermined resolution, it is necessary to reduce the slit width through which image exposure is conducted. For this reason, it is required to conduct exposing over a short period of time using light of high intensity. Therefore, the slit exposure is affected by the reciprocity law failure in the same manner as the flash exposure.

In view of the above circumstances, the present invention has been accomplished. An object of the present invention is to provide an image forming method to be applied to a flash exposure type and a slit exposure type high speed copier characterized in that: a defective image which is due to insufficient sensitivity is not caused; and a defective image which is due to a decrease in the sensitivity and an increase in the residual potential is not caused even when the high speed copier is repeatedly operated.

SUMMARY OF THE INVENTION

It is possible to accomplish the above object by employing either of the following items.

Item 1:

An image forming method using an electrophotographic photoreceptor comprising the steps of:

(1) charging the electrophotographic photoreceptor, wherein said electrophotographic photoreceptor comprising a conductive support and provided thereon, a carrier generation layer and a carrier transportation layer, said carrier generation layer comprising a carrier generation material represented by formula 1 or 2 and having X-ray diffraction pattern having peaks at 6.3°±0.2°, 12.4°±0.2°, 25.3°±0.2° and 27.1°±0.2° in Bragg angle (2θ) when using Cu-Kα ray as a X-ray radiation source in which said peak of 12.4°±0.2° has a maximum intensity and has a half width of 0.65° or more; no peak being present at 11.5°±0.2°, (2) imagewise exposing the charged photoreceptor for an exposure time of $1\times10^{-4}$ to $3\times10^{-2}$ seconds, (3) developing the imagewise exposed photoreceptor to form an image, and (4) transferring the formed image to an image receiving material:

formula 1

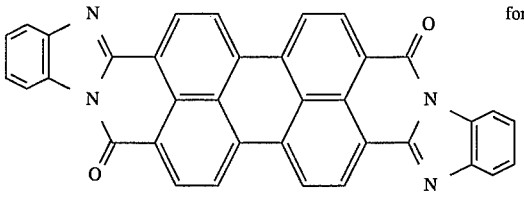

formula 2

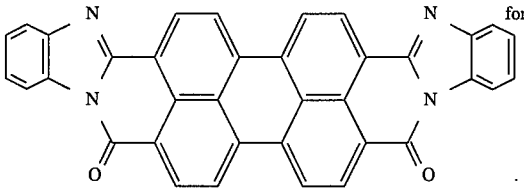

Item 2:

The image forming method of item 1, wherein said exposure time is $1\times10^{-4}$ to $2\times10^{-2}$ seconds.

Item 3:

The image forming method of item 1, wherein said electrophotographic photoreceptor comprises a hindered phenol compound having a hindered phenol moiety represented by Formula 4 or Formula 5 or a hindered phenol compound having a hindered amine moiety represented by Formula 6 or Formula 7:

Formula 4

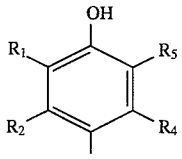

Formula 5

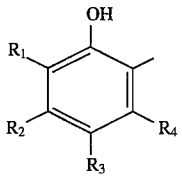

Formula 6

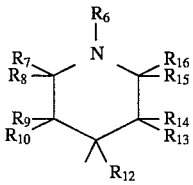

-continued

Formula 7

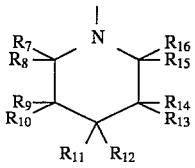

wherein $R_1$ and $R_7$ independently represents an alkyl group, $R_2$ through $R_6$ and $R_8$ through $R_{16}$ independently represent a hydrogen atom, alkyl group, alkoxy group, aryl group, aralkyl group, acyl group, halogen group, nitro group, cyano group, amide group, and carbamoyl group.

Item 4:

The image forming method of item 3, wherein said electrophotographic photoreceptor comprises a hindered phenol compound having at least two hindered phenol moieties represented by said Formula 4 or said Formula 5 or hindered amine compound having at least two hindered amine moieties represented by said Formula 6 or said Formula 7.

Item 5:

The image forming method of item 1, wherein said electrophotographic photoreceptor comprises a compound having a hindered phenol moiety represent by Formula 4 or Formula 5 and a hindered amine moiety represented by Formula 6 or Formula 7:

Formula 4

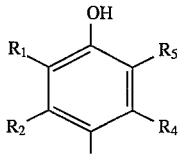

Formula 5

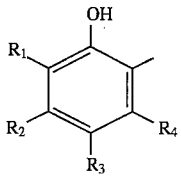

Formula 6

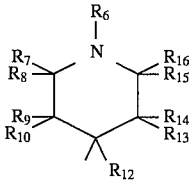

Formula 7

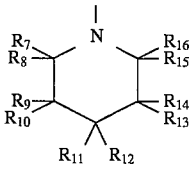

wherein $R_1$ and $R_7$ independently represents an alkyl group, $R_2$ through $R_6$ and $R_8$ through $R_{16}$ independently represent a hydrogen atom, alkyl group, alkoxy group, aryl group, aralkyl group, acyl group, halogen group, nitro group, cyano group, amide group, and carbamoyl group.

Item 6:

The image forming method of item 1, wherein said carrier transportation layer comprises a compound represented by Formula 3:

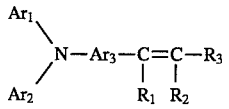

Formula 3 wherein, $Ar_1$ and $Ar_2$ independently represents an aliphatic group or aromatic group, and $Ar_3$ represents a phenylene group, provided that $Ar_1$ and $Ar_3$ may form a ring; $R_1$ and $R_2$ independently represents a hydrogen atom, an alkyl group or an aryl group; $R_3$ represents an alkyl group or aryl group, provided that $R_2$ and $R_3$ may form a ring.

Item 7:

The image forming method described in item (1), wherein an instantaneous exposure is conducted by a flash lamp in the above image exposure process.

Item 8:

The image forming method described in item (1), wherein a scanning exposure is conducted by a slit in the above image exposure process.

DESCRIPTION OF THE REFERENCE NUMERALS

Figure 1:
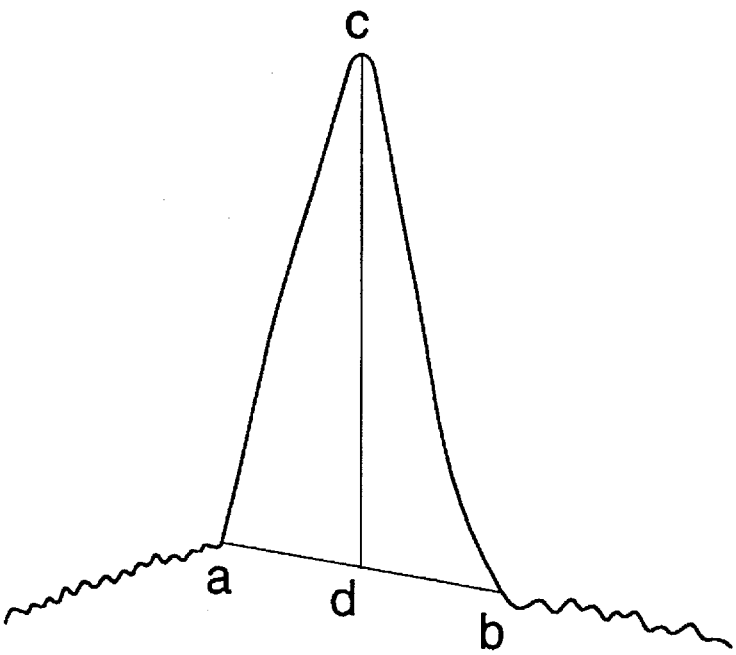
FIG. 1 is a view by which the peak intensity and the peak width at half height at the X-ray diffraction peak are defined.
Figure 1:
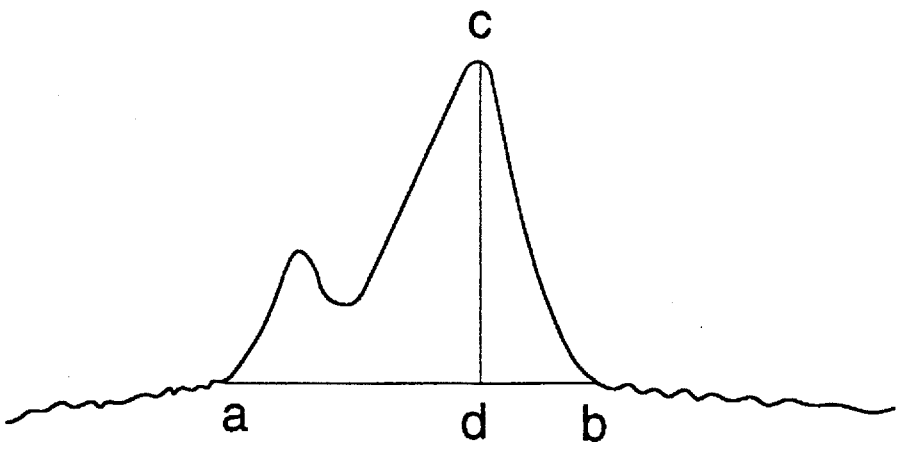
Figure 2A:
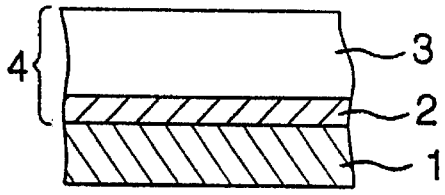
FIGS. 2A to 2F are sectional views showing a form of the electrophotographic photoreceptor according to the present invention.
Figure 2B:
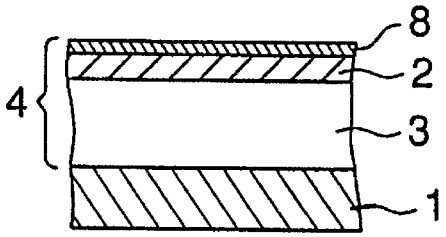
Figure 2C:
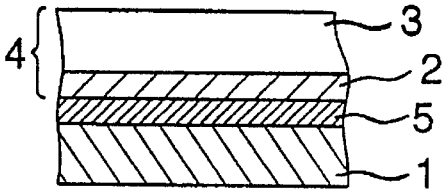
Figure 2D:
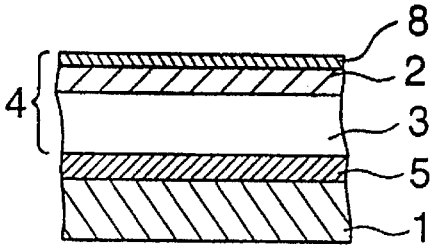
Figure 2E:
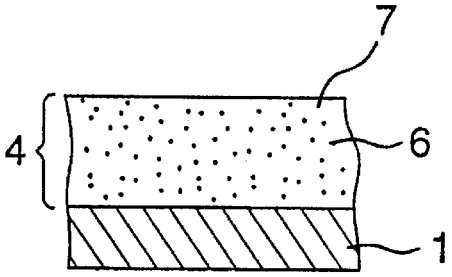
Figure 2F:
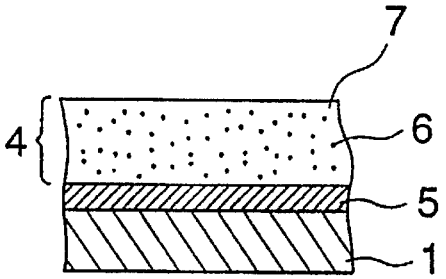

1 Conductive support
2 CGL (charge generation layer)
3 CTL (charge transport layer)
4 Photosensitive layer
5 Intermediate layer
6 Layer of which the principal component is CTM

DETAILED DESCRIPTION OF THE INVENTION

In general, in order to obtain a highly sensitive photoreceptor characteristic, it is necessary to provide a uniformely coated film in which a fine-grained carrier generation substance is coated. In other words, it is important to provide a fine-grained charge generation substance in the dispersion fine-grain process.

In the dispersion fine-grain process, the crystalline size is reduced to a predetermined value. Then, in the X-ray diffraction spectrum, the diffraction peak is broadened and the peak intensity is lowered. The ρ type crystal of the imidazole-perylene pigment of the present invention is characterized in that peaks are formed at 6.3°±0.2°, 12.4±0.2, 25.3°±0.2° and 27.1°±0.2° in the X-ray diffraction spectrum. In addition to that, a peculiar peak is formed at 11.5°±0.2° before dispersion. When ρ type crystal is subjected to the dispersion fine-grain processing, the entire peaks are broadened. The most important thing in the present invention is that the peak width at half height at the peak of 12.4°±0.2° is not less than 0.65° and the peak of 11.5°±0.2° is embedded in the thus broadened peak of 12.4°±0.2° so that no peak can be present in the region of 11.5°±0.2°. In the present invention, what is meant by "no peak" is that the crystal shows the peak intensity is less than 1/100 with respect to the maximum peak intensity. However, when the peak width of half height at the peak of 12.4°±0.2° exceeds 1.5°, the imidazole-perylene pigment is not in the condition of ρ type crystal of the present invention.

The photoreceptor characteristic of the imidazole-perylene pigment of the present invention depends on a crystal condition characterized by the relative intensity of the peak in the X-ray diffraction spectrum. At the stage of synthesis, the peak intensity of the imidazole-perylene pigment at around 6.3° is maximum in many cases. After sublimation, the peak intensity of the imidazole-perylene pigment at 25° to 28° is maximum, and in some cases, the peak intensity of the imidazole-perylene pigment at 12.4° is maximum. However, when the imidazole-perylene pigment is subjected to dispersion fine-grain processing in an organic solvent, the relative intensity of each peak is changed, so that the photoreceptor characteristic is also changed. In the crystal of the present invention, when the peak intensity at 12.4°±0.2° in the X-ray diffraction spectrum is made to be maximum, an excellent sensitivity characteristic can be provided.

According to the present invention, the grain size of the imidazole-perylene pigment is reduced to a condition in which the peak width at half height of the ρ type crystal at 12.4°±0.2° is not less than 0.65° and further a no peak is present at 11.5°±0.2°, and a condition in which the peak intensity at 12.4°±0.2° is maximum is utilized.

The dry grinding method may cause the defect of image, therefore the method to obtain the above crystal condition of the charge generation substance is not particularly limited. However, the most excellent method for preventing the defect of an electrophotographic image is described as follows. The imidazole-perylene pigment of the present invention, which has been subjected to sublimation refining, is further subjected to an acid paste treatment (to put the crystal in an amorphous condition or in a low crystalline condition). Then, the imidazole-perylene pigment is gently dispersed in an organic solvent of high affinity under the existence of a polymer binder so that the crystal is made of grow. In this way, the target crystal condition is provided. According to this method, a uniformly fine-grained pigment can be obtained. Since the mechanical shock is small, defective crystals are not made, so that the deterioration of the characteristic can be avoided.

It is possible to synthesize the imidazole-perylene pigment expressed by the structural formula (1) or (2) by a dehydration condensation reaction of imidazole-perylene-3, 4,9,10-tetracarboxylic acid bi-anhydride and o-phenylenediamine.

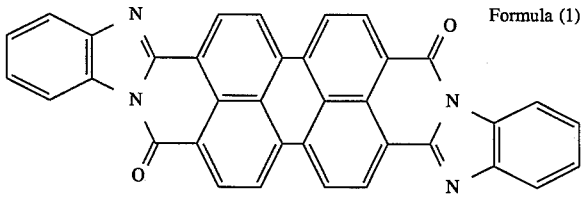

Formula (1)

-continued

Formula (2)

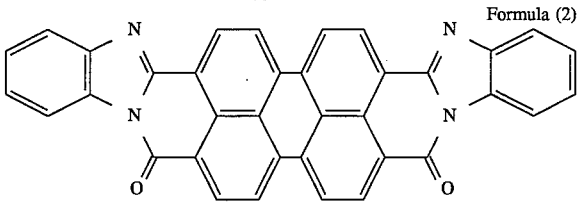

The synthesized imidazole imidazole-perylene compound is subjected to the treatment of sublimation refining so as to remove the impurities. The operation of sublimation refining is repeated by 1 to 6 times, and it is preferable that the operation is repeated at least twice. When a coating solution is prepared without sublimation refining, it is difficult to provide a crystalline condition of the present invention. After the treatment of sublimation, the imidazole-perylene compound shows a sharp peak pattern in the X-ray diffraction spectrum. Therefore, it can be confirmed that the imidazole-perylene compound is in a highly crystalline condition.

When the high crystalline imidazole-perylene compound obtained by the sublimation refining treatment is converted into a condition of low crystallinity by the acid paste treatment. That is, after the imidazole-perylene compound has been dissolved in concentrated sulfuric acid, the solution is put into a poor solvent such as water or methanol and precipitated. Then, the precipitation is filtered and dried, so that fine-grained powder of low crystallinity can be obtained.

After the acid paste treatment has been completed, powder of low crystallinity is subjected to dispersion treatment using an appropriate dispersing machine in a solvent, the affinity for imidazole-perylene compound of which is high. Examples of the usable solvent having a high affinity are: ketone solvent, the carbon number of which is 4 to 8; cyclic ether solvent, the carbon number of which is 4 to 7; and hydrocarbon halide solvent, the carbon number of which is 2 to 4. Preferable solvents are: methylethyl ketone, methylisopropyl ketone, methylisobutyl ketone, cyclohexanone, terahydrofuran, dichloroethane, and trichloroethane. In this dispersion treatment, when an appropriate binder polymer is in existence, the effect can be further enhanced.

Examples of preferable binder polymers are: polyvinyl acetal resin such as polyvinyl butyral and polyvinyl formal, vinylchloride-vinyl acetate resin, polyester resin, polycarbonate resin, acrylic resin, methacrylic resin, acrylic and methacrylic copolymer resin, silicon resin, silicon copolymer resin, polystyrene, styrene copolymer resin, phenoxy resin, phenol resin, urethane resin, and epoxy resin.

In the dispersion coating solution obtained by the method described above, it is possible to realize the specific crystalline condition of the present invention. According to this method, purification accomplished by sublimation refining is important for adjusting the crystalline condition in the process of dispersion. In the process of dispersion, the crystal is made to grow from the amorphous condition (or from a condition of low crystallinity) by the effect of a specific solvent. Due to the foregoing, from a viewpoint entirely different from that of the prior art, the specific crystalline condition of the present invention can be provided.

A photoreceptor is made using the thus obtained dispersion coating solution. Whether or not the crystalline condition of the present invention has been realized in the photoreceptor can be confirmed by measuring the X-ray diffraction spectrum of the imidazole-perylene pigment peeled off from the photoreceptor. Since the crystalline condition does not change in the process of coating the solution on the photoreceptor surface, the X-ray diffraction spectrum may be measured after the solvent has been removed from the dispersion coating solution.

The spectra of these samples are measured with a powder X-ray diffractometer in which Cu-Kα rays are used as the X-ray source. According to the measurement effected by the samples are measured with a powder X-ray diffractometer, a diffraction intensity distribution can be obtained as a function of the Bragg angle (2θ). When the amount of samples is sufficiently large, a ratio of relative intensity between the peak intensities does not change, however, when the amount of samples is small, the peak intensity on the small angle side is relatively increased. Accordingly, a sufficiently large amount of samples must be used in the measurement so that the ratio of peak intensity can not be changed by the number of samples.

In this case, the peak intensity is defined as follows. As illustrated in FIG. 1, rising points from the base line level including noise are points "a" and "b". Point "d" is a point of intersection formed by a straight line connecting point "a" with point "b" and a perpendicular line of the top "c". The height of the top "c" from the point of intersection "d", that is, the length of straight line "c"–"d" is defined as the peak intensity. Peak width at half height at this peak is defined as the peak width at the height of "cd/2" on the basis of point "d".

Examples of usable CTM are: oxazole derivative, oxadiazole derivative, thiazole derivative, thidiazole derivative, triazole derivative, imidazole derivative, imidazolone derivative, imidazolidine derivative, bisimidazolidine derivative, styryl compound, hydrazone compound, pyrazoline derivative, triphenyl amine derivative, oxazolone derivative, benzothiazole derivative, benzimidazole derivative, quinazoline derivative, benzofuran derivative, acridine derivative, phenazine derivative, aminostilbene derivative, poly-N-vinylcarbazole, poly-1-vinylpyrene, and poly-9-vinylanthracene.

Examples of specific chemical compounds of carrier transportation material (CTM) used for the photoreceptor of the present invention are shown as follows, however, it should be noted that the present invention shall be not limited by the specific examples.

T-1

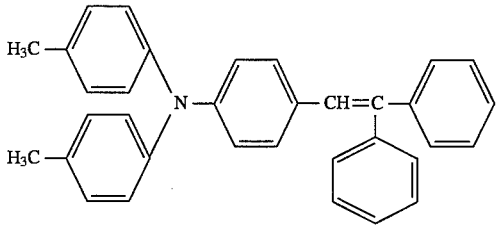

T-2

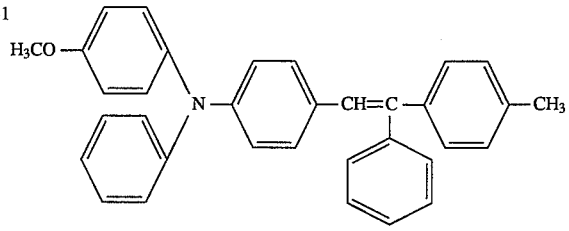

-continued
T-3
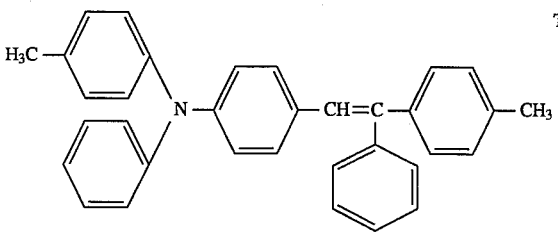
T-4
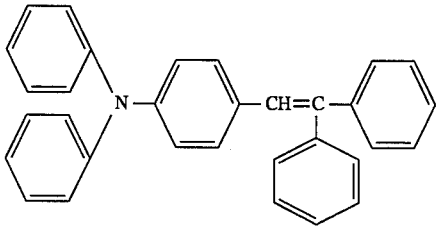
T-5
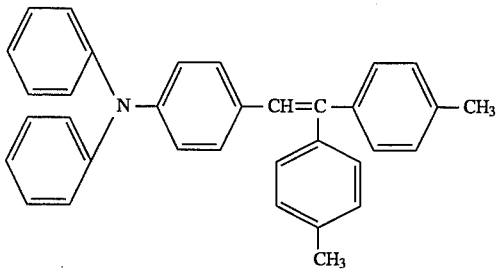
T-6
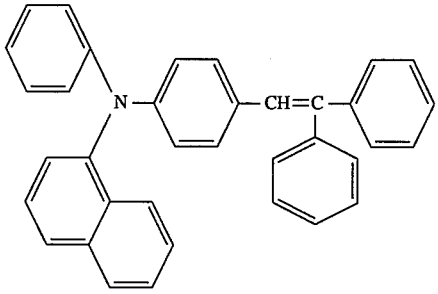
T-7
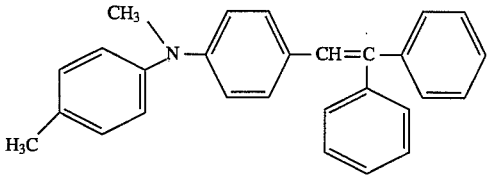
T-8
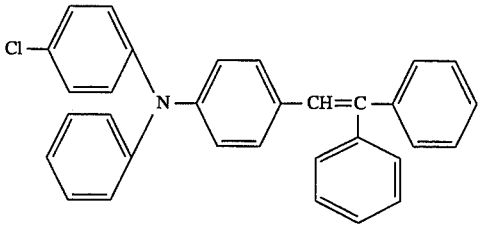
T-9
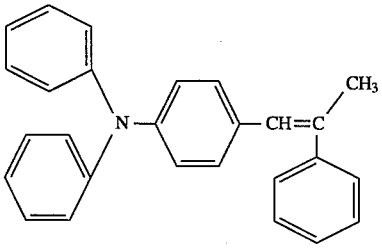
T-10
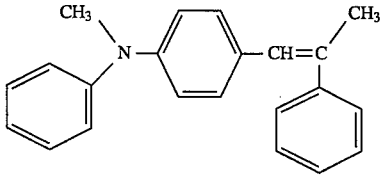
T-11
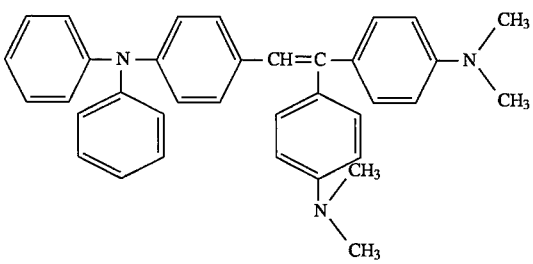
T-12
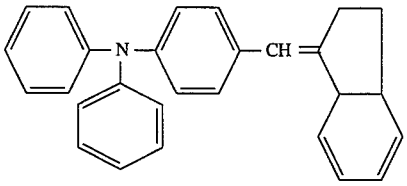
T-13
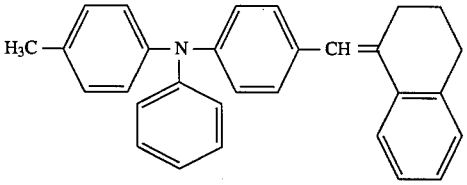
T-14
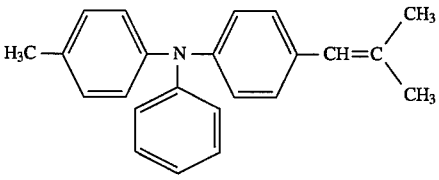

-continued
T-15
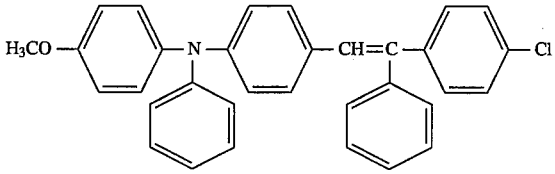
T-16
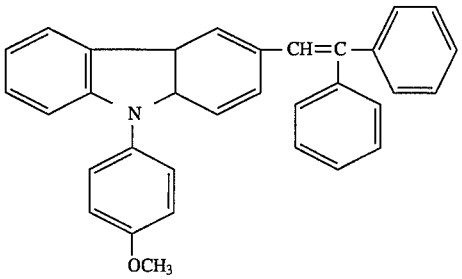
T-17
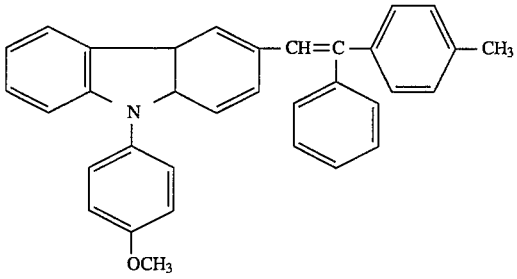
T-18
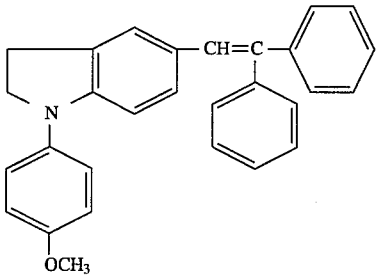
T-19
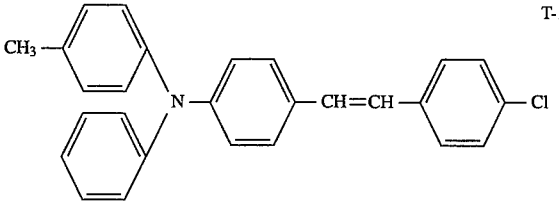
T-20
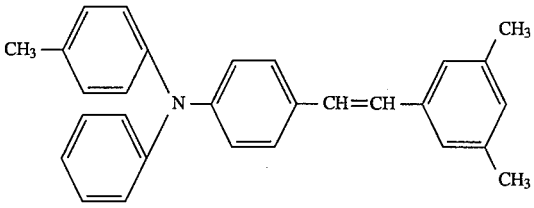
T-21
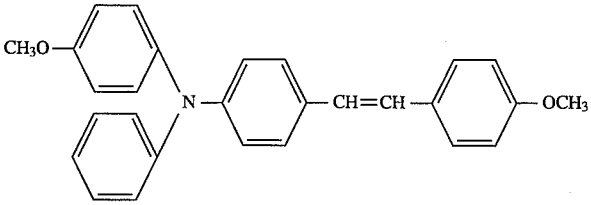
T-22
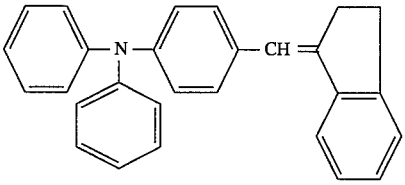
T-23
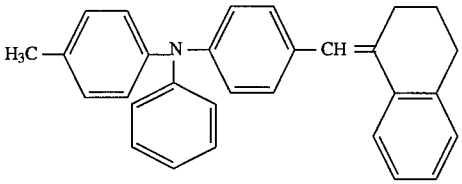
T-24
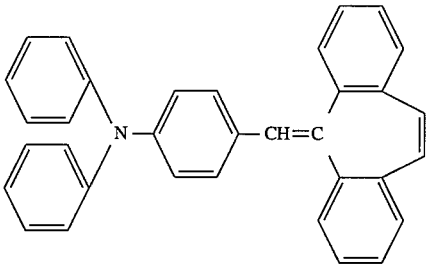
T-25
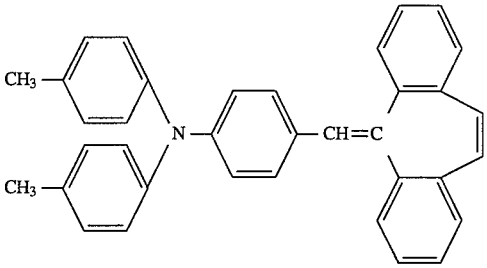

-continued
T-26
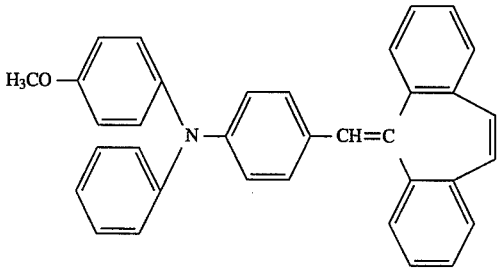
T-27
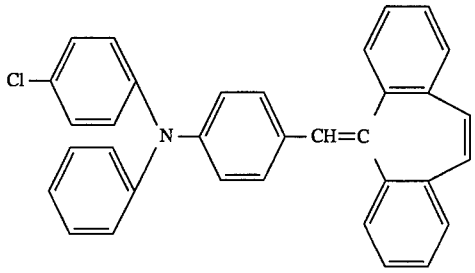
T-28
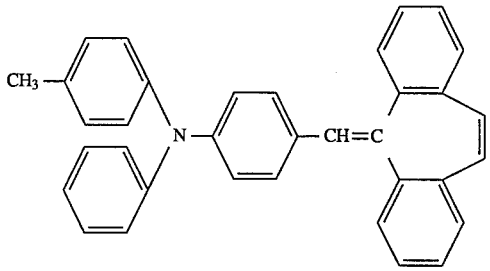
Further, examples of specific chemical compounds of carrier transportation material (CTM) expressed by formula (3), which are preferably used in the present invention, are shown below.
U-1
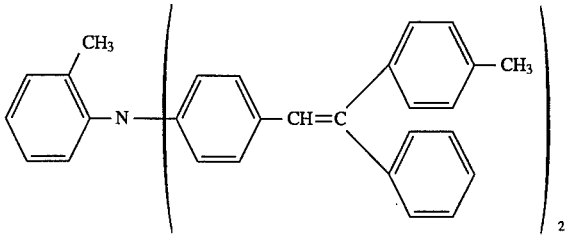
U-2
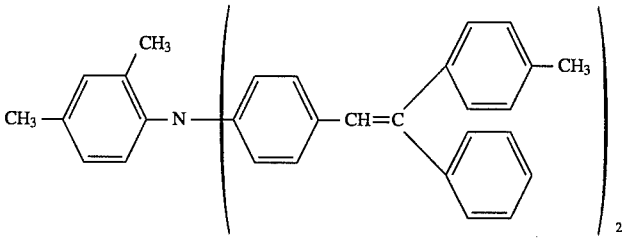
U-3
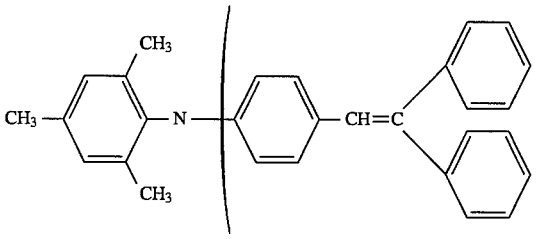
U-4
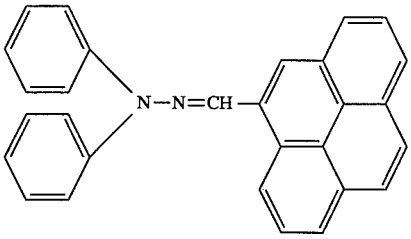
U-5
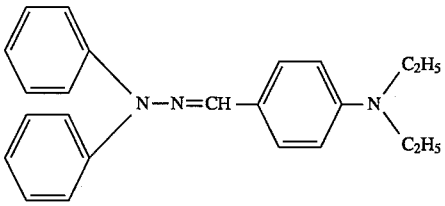
U-6
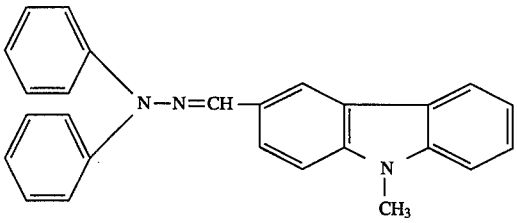

-continued
U-7
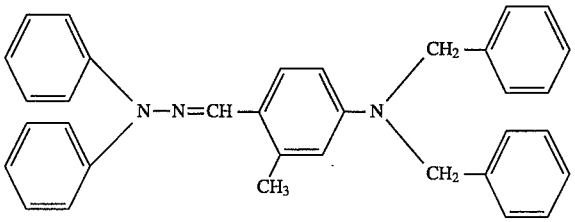
U-8
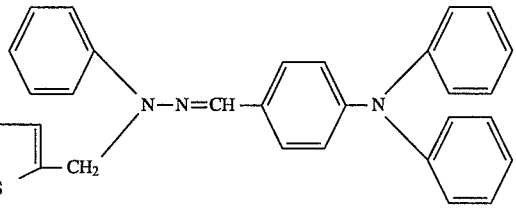
U-9
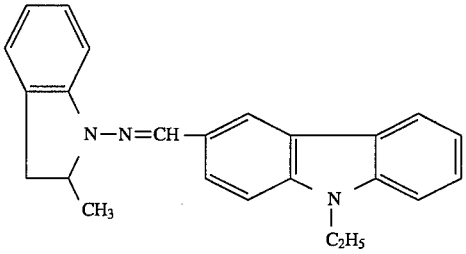
U-10
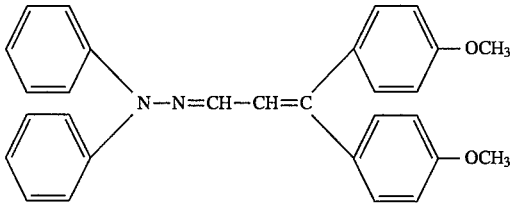
U-11
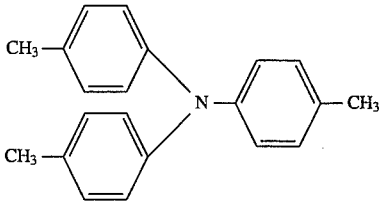
U-12
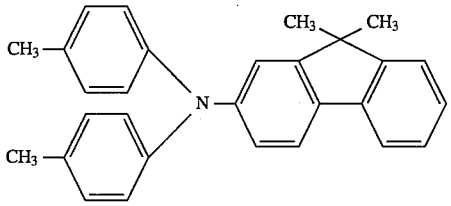
U-13
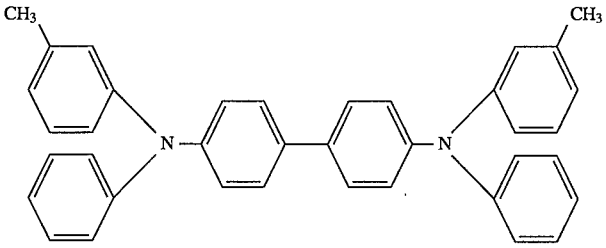
U-14
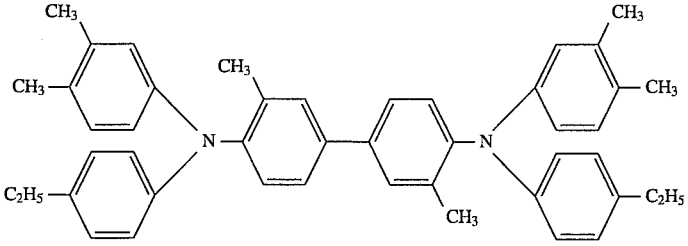
U-15
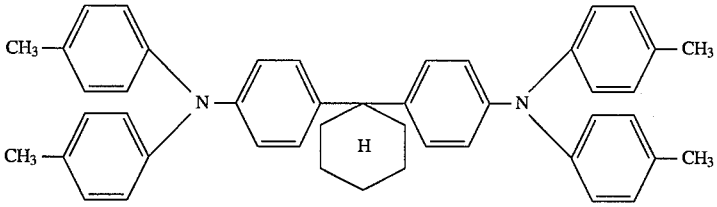

-continued

U-16

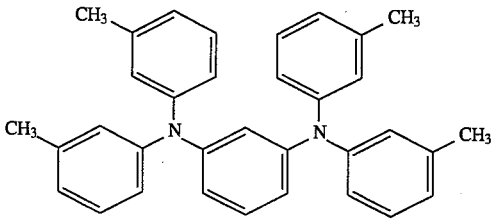

U-17

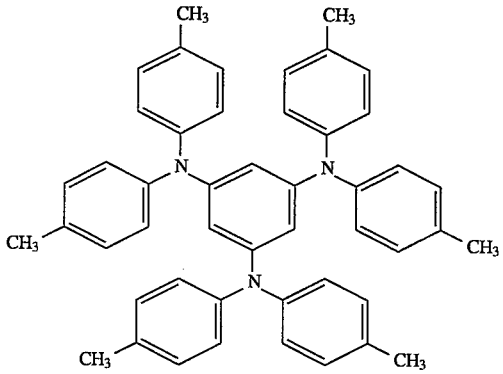

U-18

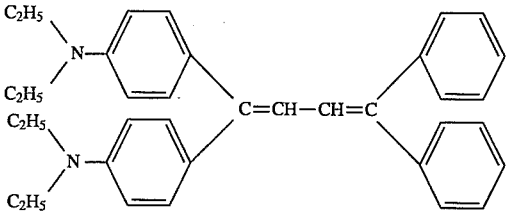

U-19

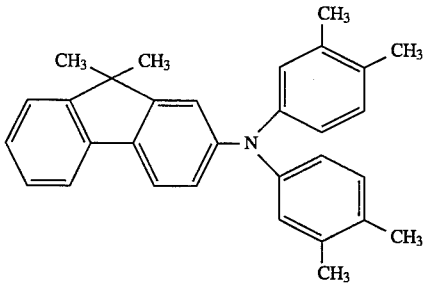

Film forming ability of the chemical compounds expressed by formulas (1) and (2) and formula (3) relating to the present invention is not sufficiently high. Accordingly, various types of binders may be added to the chemical compounds so as to form a photosensitive layer.

An arbitrary binder resin may be used for the formation of the photosensitive layer. It is preferable to use an electrically insulating high polymer having a film forming ability, the hydrophobicity and permittivity of which are high. Examples of usable high polymers are: polycarbonate, polyester, methacrylic resin, acrylic resin, polyvinyl chloride, polyvinylidene chloride, polystyrene, polyvinyl acetate, styrene-butadiene copolymer, vinylidene chloride-acrylonitrile copolymer, vinyl chloride-vinyl acetate copolymer, vinyl chloride-vinyl acetate-maleic acid anhydride copolymer, silicon resin, silicon-alkyd resin, phenol-formaldehyde resin, styrene-alkyd resin, poly-N-vinyl carbazole, polyvinyl acetal (for example, polyvinyl butyral). These binder resins are used singly, or alternatively these binder resins are used in the form of mixture in which not less than two binder resins are mixed.

In order to prevent an increase of the surface potential of the exposed are residual potential on the photoreceptor when the photoreceptor is repeatedly used, especially in order to prevent an increase of the potential of the exposure section when the photoreceptor is repeatedly used under the condition of high temperature and humidity, a chemical compound functioning as an antioxidant may be added. Examples of usable antioxidants are hindered phenol compound having a hindered phenol moiety, hindered amine compound having a hindered amine moiety, paraphenylene diamine, aryl alkane, hydroquinone, spirochroman, spiroindanone, these derivatives, organic sulphur compound, and organic phosphorus compound. In these chemical compounds, it is preferable to use a chemical compound having a hindered phenol moiety or a hindered amine moiety. It is most preferable that the same molecule at least 2 hindered phenol moieties or hindered amine moieties. The preferable structure of the above hindered phenol moiety can be expressed by formula (4) or (5), and the preferable structure of the above hindered amine moiety can be expressed by formula (6) or (7).

(4)

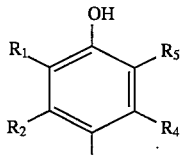

(5)

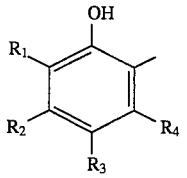

(6)

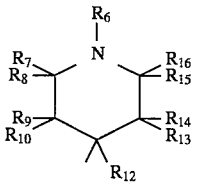

(7)

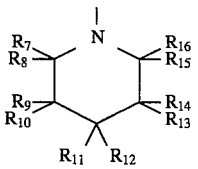

wherein $R_1$ and $R_7$ independently represents an alkyl group, $R_2$ through $R_6$ and $R_8$ through $R_{16}$ independently represent a hydrogen atom, alkyl group, alkoxy group, aryl group, aralkyl group, acyl group, halogen atom, nitro group, cyano group, amide group or carbamoyl group.

Specific examples of usable chemical compounds are shown below.

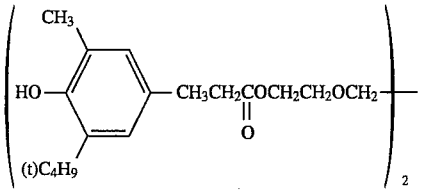
A-1
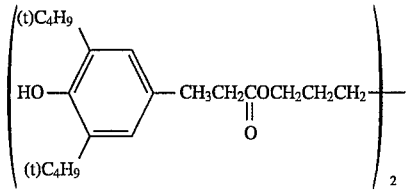
A-2
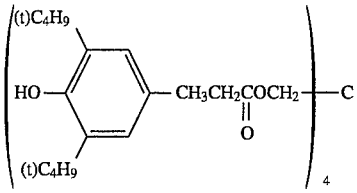
A-3
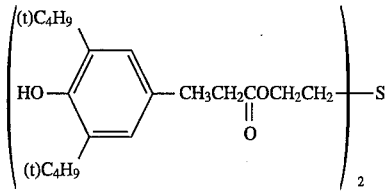
A-4
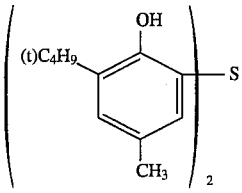
A-5
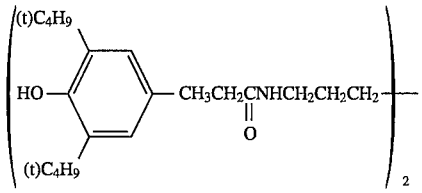
A-6
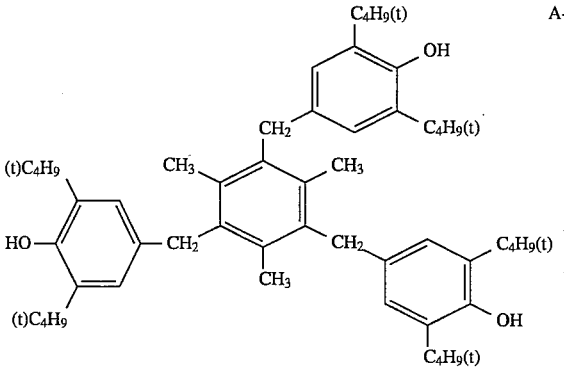
A-7
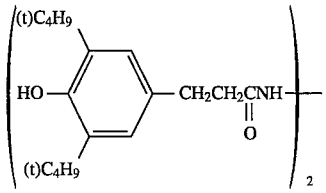
A-8
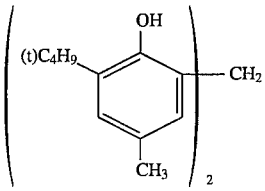
A-9
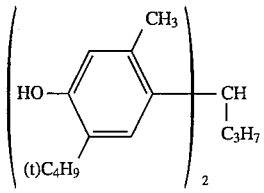
A-10
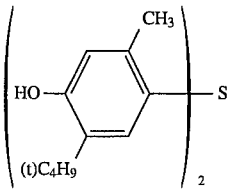
A-11
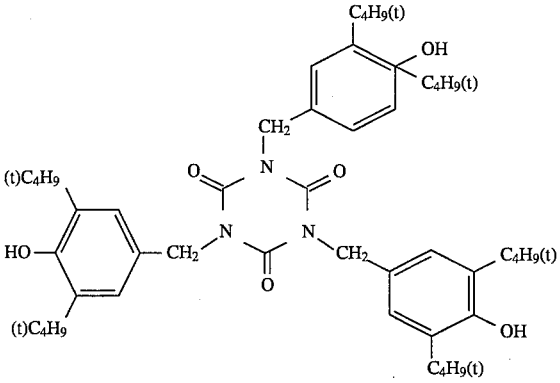
A-12

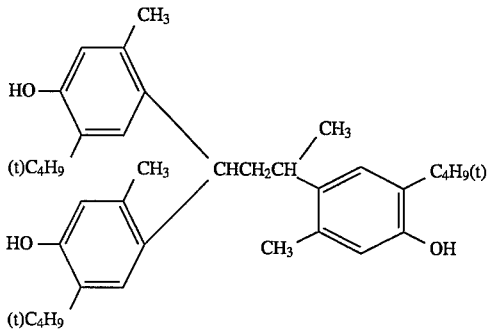
-continued
A-13
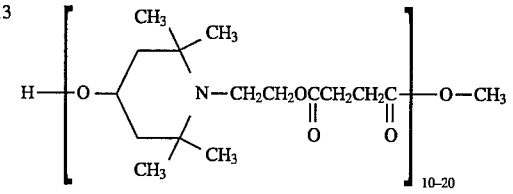
A-14
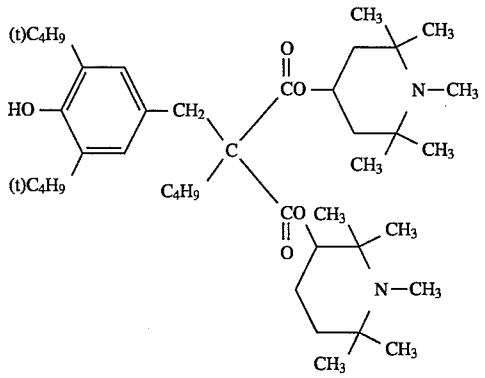
A-15
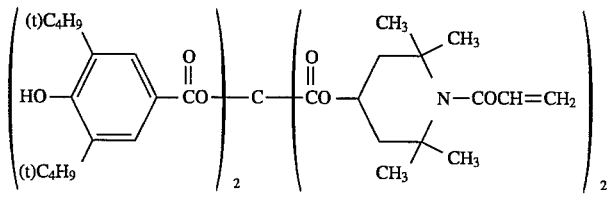
A-16
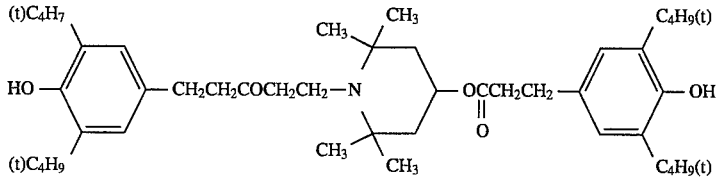
A-17
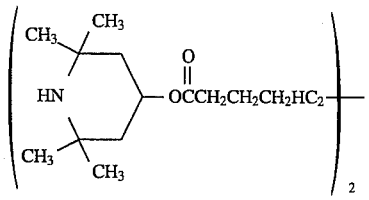
A-18
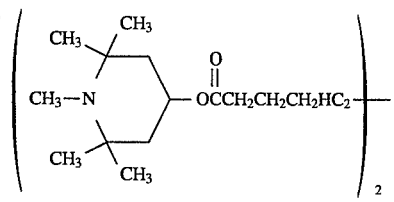
A-19
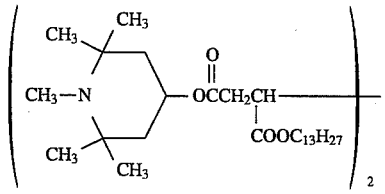
A-20
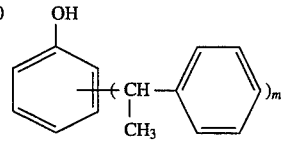
A-21

-continued

A-22

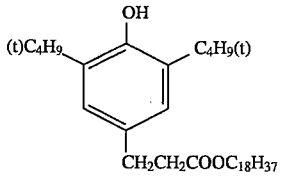

A-23

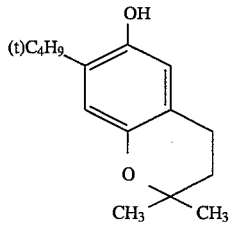

A-24

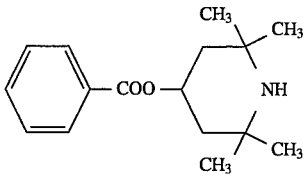

A-25

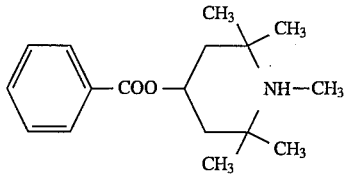

A-26

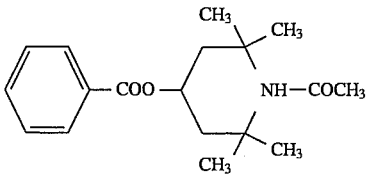

A-27

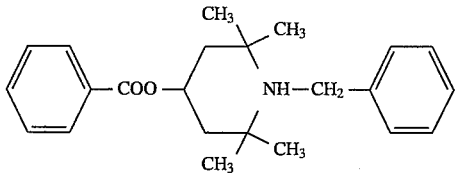

A-28

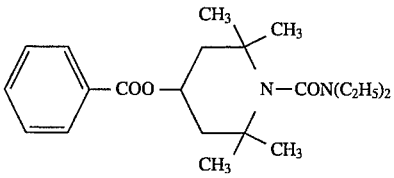

Specific chemical compounds used as the antioxidant are described in Japanese Patent Publication Open to Public Inspection No. 14154/1988, 18355/1988, 44662/1988, 50848/1988, 50849/1988, 58455/1988, 71856/1988, 71857/1988 and 146046/1988.

From the viewpoint of the chemical structure of these chemical compounds, they are within the category of a chemical compound commonly known as an antioxidant. Therefore, these chemical compounds are referred to as an AO agent (antioxidant). However, the action of these chemical compounds has not been sufficiently clarified yet. It is considered that the chemical compounds are effective for preventing the oxidization caused by ozone. However, these chemical compounds are effective when they are added to not only CTL which is a surface layer, but also CGL which is an inner layer. For this reason, it is considered that the effects of the chemical compounds are not limited to the prevention of oxidization caused by ozone. When the chemical compounds are added to CTL, 0.1 to 100 weight parts of the chemical compounds are added to 100 weight parts of CTM. It is preferable that 1 to 50 weight parts are added, and it is more preferable that 5 to 25 weight parts are added. When the chemical compounds are added to CGL, 1 to 100 weight parts of the chemical compounds are added to 100 weight parts of CGM.

Sensitivity of the photoreceptor of the present invention is high, and besides the photoreceptor of the present invention is excellent in the reciprocity response. Therefore, the photoreceptor of the present invention is suitable for a process which requires a high speed and a short exposure time. The inventors are investigating the reasons. The following are the understanding of the inventors: In order to accomplish a high speed and a short exposure time, it is required that the photoreceptor is highly sensitive, that is, the light quantum efficiency is high, and at the same time, no residual electric charge accumulates in the photoreceptor.

In order to meet the above requirements, of course, it is necessary that the electric charge moving speed in CTL is high, and it is also necessary that the electric charge moving speed in CGL is high, and it is required that no electric charge accumulates on the interface of CGL/CTL and the residual electric charge quickly leaks in each cycle of operation. It is presumed that the performance of the imidazole-perylene compound having the crystal form of the present invention meets the requirement described above and that the AO agent is not a simple antioxidant and it has a function of acting an interface of CTL/CGL. Of course, when the AO agent is added to CGL, even when the AO agent is added to CTL, it diffuses so that the effect of the AO agent can be exhibited on the interface of CTL/CGL.

An object of the present invention is to enhance the sensitivity of the photosensitive layer and to reduce the residual potential and fatigue in the case where the photoreceptor is repeatedly used. In order to accomplish the above object, the photosensitive layer may contain one type or not less than two types of electron accepting substance of the prior art.

An addition amount of the electron accepting substance is determined as follows. With respect to 100 weight parts of electron accepting substance (CGM), 0.01 to 200 weight parts of the electron accepting substance are added. It is preferable that 0.1 to 100 weight parts of the electron accepting substance are added.

The electron accepting substance may be added to the carrier transportation layer (CTL). An addition amount of the electron accepting substance to the carrier transportation layer (CTL) is determined as follows. With respect to 100 weight parts of CTM, 0.01 to 100 weight parts are added, and it is preferable that 0.1 to 50 weight parts are added. Examples of usable electron accepting substances are: maleic acid anhydride, phthalic acid anhydride, tetracyanoethylene, tetracyanoquinodimethane, chloranil, 2,4,7-trinitrofluorenone, and other chemical compounds having a high electron affinity.

Organic amine may be added to the photosensitive layer for the purpose of improving the carrier generation ability of CGM. In this case, it is preferable to add secondary amine.

These chemical compounds are described in Japanese Patent Publication Open to Public Inspection Nos. 218447/1984 and 8160/1987.

When necessary, in order to protect the photosensitive layer, the photoreceptor may contain an ultraviolet ray absorbing agent. Besides, the photoreceptor may contain a dye for correcting spectral sensitivity.

The following are primarily used for the conductive support of the photoreceptor of the present invention, however, it should be noted that the present invention shall be not limited to the specific example.

(1) Metal sheet such as an aluminum sheet or stainless steel sheet (2) Conductive support made of paper or plastic covered with a thin metallic film of aluminum, palladium or gold by means of lamination or vapor-deposition.

(3) Conductive support made of paper or plastic covered with a layer of conductive compound of conductive polymer, indium oxide or tin oxide by means of coating or vapor-deposition.

On the support of the photoreceptor of the present invention, there are provided a carrier generation layer (CGL) and a carrier transportation layer (CTL). When necessary, an auxiliary layer such as a protective layer, intermediate layer, barrier layer and adhesion layer may be provided on the support. For the improvement in the workability and physical property, that is, for the prevention of cracks and for the improvement of flexibility, when necessary, thermoplastic resin of lower than 50 weight % may be added to the protective layer of the present invention.

Other than the binder resin described above, the following function as the intermediate layer, adhesion layer or blocking layer. Examples of usable chemical compounds are: polyvinylalcohol, ethylcellulose, carboxymethylcellulose, casein, copolymer nylon, N-alkoxymethyl nylon, and starch.

Examples of usable solvents or dispersing mediums are: butylamine, diethylamine, ethylenediamine, isopropanolamine, triethanolamine, triethylenediamine, N,N-dimethylformamide, acetone, methylethlyketone, cyclohexanone, benzene, toluene, xylene, chloroform, 1,2-dichloroethane, 1,2-dichloropropane, 1,1,2-trichloroethane, 1,1,1-trichloroethane, trichloroethylene, tetrachloroethane, dichloromethane, tetrahydrofuran, dioxane, methanol, ethanol, isopropanol, ethyl acetate, butyl acetate, dimethyl sulfoxide, and methyl cellosolve.

Formations of the electrophotographic photoreceptor of the present invention are shown in FIGS. 2(1) to 2(6).

In the photoreceptor of the present invention, as illustrated in FIGS. 2(1) and 2(2), on the conductive support 1, there is provided a photosensitive layer 4 composed of a laminated body of CGL2, the principal component of which is CGM of the present invention, and also composed of CTL3, the principal component of which is CTM.

As illustrated in FIGS. 2(3) and 2(4), an intermediate layer 5 may be interposed between the photosensitive layer 4 and the conductive support 1.

When the photosensitive layer is composed of two layers as described above, it is possible to provide an electrophotographic photoreceptor, the electrophotographic characteristic of which is excellent.

In the present invention, as illustrated in FIGS. 2(5) and 2(6), the photosensitive layer 4 may be directly provided on the conductive support 1, or alternatively the photosensitive layer 4 may be provided on the conductive support 1 through the intermediate layer 5, wherein the photosensitive layer 4 includes a layer 6, the principal component of which is CTM described above, in which fine-grained CGM7 is dispersed.

When necessary, a protective layer 8 may be provided on the photosensitive layer 4.

When the photosensitive layer 4 is composed of two layers as illustrated in FIGS. 2(1) to 2(4), CGL2 may be formed on the conductive support 1 or CTL3 directly or if necessary through an intermediate layer such as an adhesion layer or a blocking layer. In this case, the following methods may be employed.

(1) Vapor-deposition method (2) Method of coating a solution in which CGM is dissolved in an appropriate solvent (3) Method in which CGM is made to be fine grains in a dispersion medium using a ball mill or sand grinder, if necessary, fine-grained CGM is mixed with and dispersed in a binder, and the thus obtained dispersing solution is coated.

Specifically, a gas phase sedimentation method such as vapor deposition, spattering and CVD may be employed, or alternatively a coating method such as dipping, spraying, blading and rolling may be arbitrarily used.

It is preferable that the thickness of the thus obtained CGL2 is 0.01 to 5 μm. It is more preferable that the thickness of the thus obtained CGL2 is 0.05 to 3 μm.

It is possible to form CTM3 in the same manner as that of CGL2.

It is possible to change the thickness of CTL3, if necessary. Commonly, it is preferable that the thickness is 5 to 30 μm. Concerning the composition of CTL3, it is preferable that 0.1 to 5 weight parts of binder is used with respect to 1 weight part of CTM. In order to form a photosensitive layer 4 on which fine-grained CGM7 is dispersed, it is preferable that not more than 5 weight parts of binder is used with respect to 1 weight part of CGM.

In the case where CGL is previously dispersed in the binder, it is preferable that not less than 5 weight parts of binder is used with respect to 1 weight part of CGM.

Figure 3:
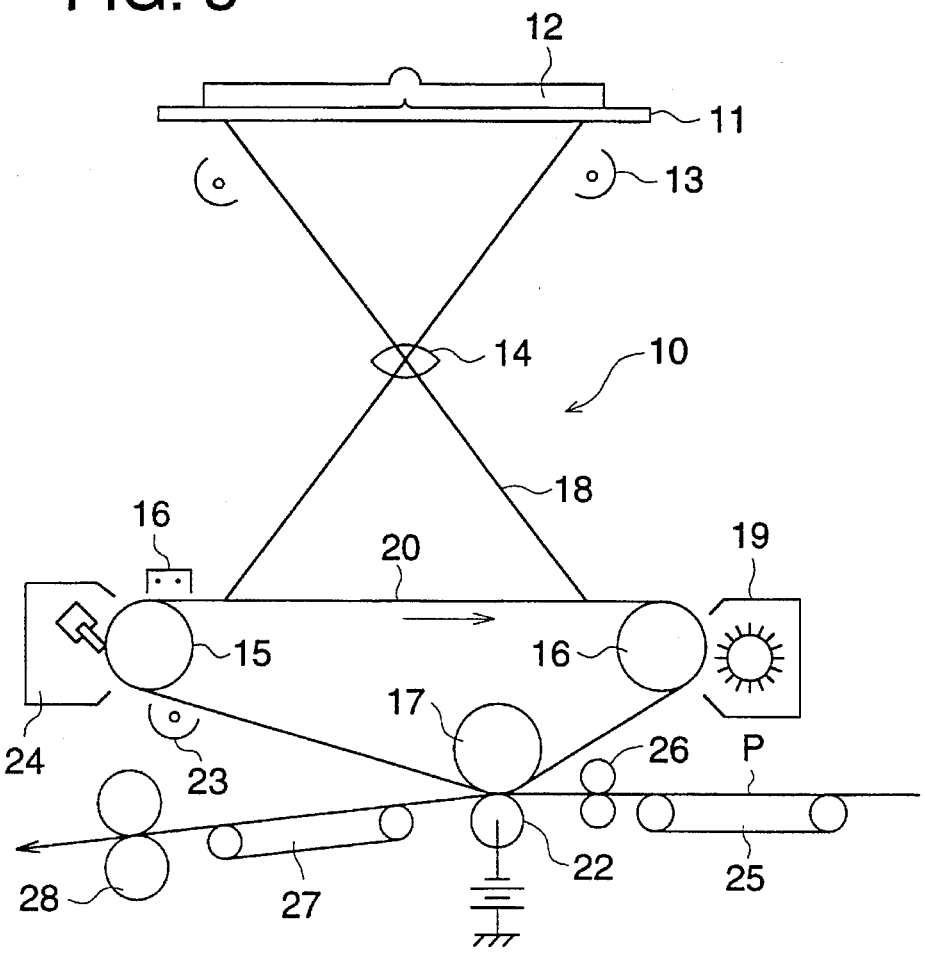
FIG. 3 is a schematic illustration showing a concept of the flash type exposure system according to the present invention.
Figure 4:
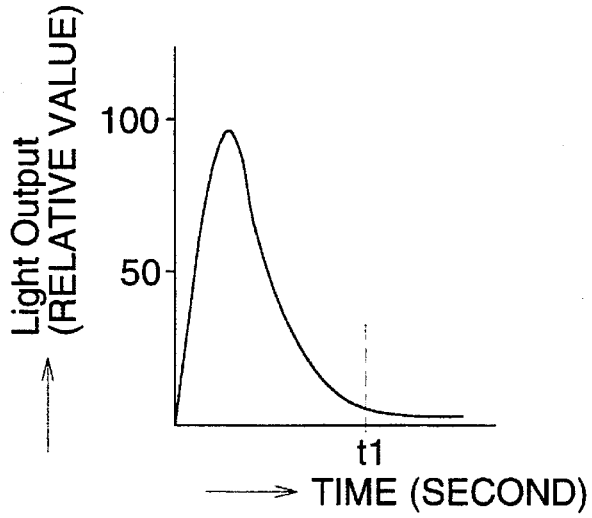
FIG. 4 is a graph on which the strobe light emitting time and the optical output are shown.

The photoreceptor of the present invention is explained above. With reference to FIGS. 3 and 4, an image forming method using the photoreceptor is explained as follows.

FIG. 3 is a schematic illustration of the flash exposure type copier. As illustrated in the drawing, a belt-shaped photoreceptor 20 is wound around rollers 15, 16, 17. The belt-shaped photoreceptor 20 is conveyed in the arrowed direction at a conveyance speed of 300 to 800 mm/sec. Then the belt-shaped photoreceptor 20 is uniformly charged by a charger 16. Then a surface of the belt-shaped photoreceptor 20 is subjected to flash exposure by a flash exposure device 10, so that an electrostatic latent image is formed on the photoreceptor belt at high speed. This electrostatic latent image is subjected to magnetic brush development by a developing unit 19, so that a toner image is formed. This toner image is transferred onto a transfer sheet P, which has been fed by a transfer sheet feed means 25, 26, by the action of a transfer roller 22 upon which a DC bias is impressed. Then the transfer sheet is conveyed to a fixing unit 28 by a conveyance means 27. After the transferred image has been fixed onto the transfer sheet, it is discharged outside the apparatus.

For the exposure lamp 13 of the flash exposure device 10, for example, a mercury lamp, xenon discharge lamp, cesium arc lamp, and stroboscopic tube (cold cathode lamp) are used. However, the above stroboscopic tube is generally used.

As illustrated in FIG. 4, the stroboscopic tube is a light source from which a ray of light of high intensity is instantaneously outputted. In order to provide an appropriate exposure onto the photoreceptor, it is necessary to give consideration to the sensitivity characteristic of the photoreceptor, conveyance speed V mm, and required resolution. While these factors are taken into consideration, a voltage impressed upon the drive circuit of the stroboscopic tube, capacity of the condenser and time constant (CR) are controlled.

A copier including the above flash exposure device is used as a high speed type copier, for example, according to Japanese Patent Publication Open to Public Inspection No. 71225/1973, the copying speed is not less than 100 sheets/min in the case where the exposure time is approximately $10^{-4}$ sec, specifically, the copying speed is 125 sheets/min in the case where the exposure time is $8\times10^{-4}$ sec.

On the graph shown in FIG. 4, the horizontal axis represents a stroboscopic luminous time (sec), and the vertical axis represents a relative value of the optical output when the maximum value is set at 100. In general, the effective luminous time is approximately $10^{-4}$ sec.

The image formation lens 14 is a lens for forming an image on the surface of the photoreceptor 20 when a document 12 on a platen 11 is entirely exposed by an exposure lamp 13 and the thus obtained reflecting rays of light is incident upon the image formation lens 14. In the copier shown in FIG. 3, exposure is effected under the condition of life-size, however, the image formation lens may be vertically moved so that the formed image can be magnified or reduced. In order to obtain a higher resolving power, the image formation lens may be moved in the moving direction of the photoreceptor at a half speed of the photoreceptor (in the case of life-size exposure).

Figure 5:
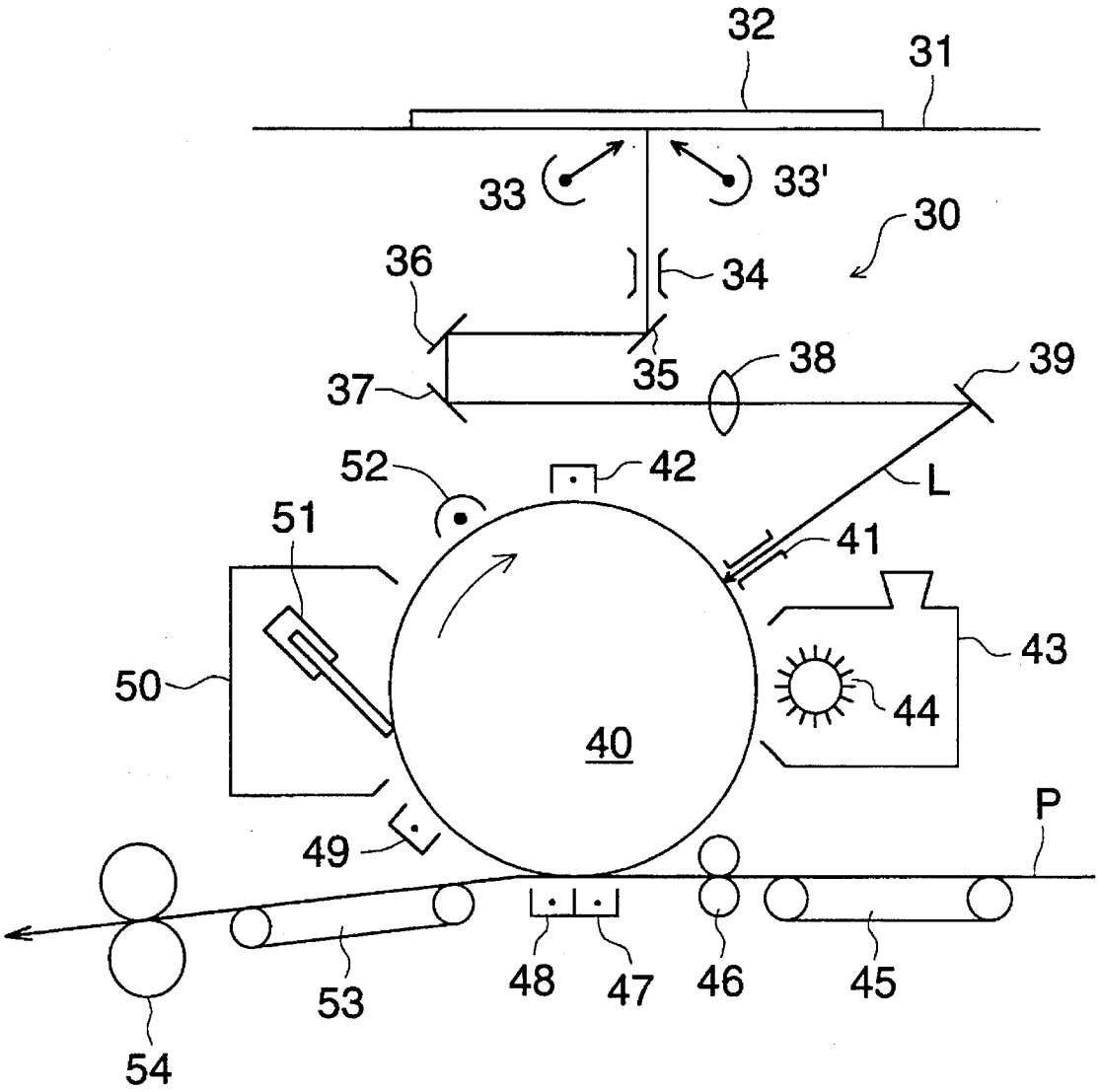
FIG. 5 is a schematic illustration of the slit exposure type copier according to the present invention.

FIG. 5 is a schematic illustration showing a slit exposure type copier. Reference numeral 40 is a photoreceptor according to the present invention. That is, reference numeral 40 is a drum-shaped photoreceptor rotated in the arrowed direction at a speed of 300 to 800 mm/sec. After the photoreceptor has been uniformly charged by the charger 42, image exposure is effected by the rays of light obtained when the document 32 on the platen 31 is subjected to optical scanning. Due to the foregoing operation, an electrostatic latent image is formed. When the thus obtained electrostatic latent image is developed by the magnetic brush 44 of the developing unit 43, a toner image is formed on the surface of the photoreceptor. This toner image is transferred by the action of the transfer pole 47 onto a transfer sheet P which has been fed by the sheet feed means 45, 46 in timed relation with the image formation. Then the transfer sheet P is separated by the action of the separation pole 48 and conveyed to the fixing unit 54 by the conveyance means 53. Then the image is fixed by the fixing unit 54. In this way, image formation is carried out.

After the transfer has been completed, the photoreceptor is discharged by the discharged 49, and then the surface of the photoreceptor is cleaned by the cleaning blade 51 of the cleaning unit 50. Then the residual potential is removed from the surface of the photoreceptor by the action of the exposure lamp 52 so as to prepare for the next image formation.

In the above exposure device 30, the document 32 is optically scanned by the rays of light emitted from a halogen lamp or fluorescent lamp 33, 33'. The reflected light passes through the slit 34 on the platen side, reflecting mirror 35, V-mirrors 36, 37, image formation lens 38, reflecting mirror 39, and slit 41 on the photoreceptor side. After that, the photoreceptor 40 is subjected to image exposure.

Widths of the slits 34 and 41 are determined in accordance with the resolving power. Especially, the width of the slit 41 has much influence on the resolving power. Commonly, the width d of the slit 41 is determined to be 5 to 20 mm. Exposure time $V_p/d=t$ is determined to be not less than $1\times10^{-4}$ sec and not more than $3\times10^{-2}$, wherein the moving speed of the photoreceptor is $V_p$ mm/sec.

As explained above, the flash or slit exposure system is employed in the image forming method of the present invention. Even in a high speed copying process in which the exposure time t is restricted to be not less than $1\times10^{-4}$ sec and not more than $3\times10^{-2}$ sec, it is possible to obtain a sufficiently high sensitivity by using the photoreceptor, the characteristic of which is excellent. Besides, there is no possibility of the occurrence of image defect caused by the reduction of sensitivity and the increase of residual potential.

Concerning the exposure time t shorter than $1\times10^{-4}$ sec, it is difficult to realize a copier in which the exposure time t shorter than $1\times10^{-4}$ sec can be accomplished in view of the copier mechanism, and there is no demand for the copier in customers.

When the exposure time t exceeds $3\times10^{-2}$ sec, it is impossible to realized a high speed copying process.

EXAMPLES

Examples of the present invention will be explained as follows. However, it should be noted that the present invention is limited to the specific examples.

Example-A

Synthesis Example

In this synthesis example, 39.2 g of imidazole-perylene-3,4,9,10-tetracarboxylic dianhydride, 32.4 g of o-phenylene diamine, and 800 ml of α-chloronaphthalene were mixed and reacted for 6 hours at 260° C. After cooling, the precipitation was filtered and repeatedly washed in methanol, and then dried. In this way, a mixture of formula 1 and formula 2 the imidazole-parylene compounds was synthesized.

Sublimation Refining Example

The imidazole-perylene compounds obtained in the above example of synthesis was subjected to sublimation refining under the pressure of $5\times10^{-4}$ to $5\times10^{-3}$ torr at 500° C. Volatile impurities were removed with a shutter. The thus obtained refined crystals were further subjected to the same sublimation refining so that the exemplary chemical compound was further purified. The thus obtained chemical Compound, which was subjected to sublimation treatment twice, is referred to as a sublimation product in this specification.

Acid Paste Treatment Example

In this example, 20 g of the sublimation product of the imidazole-perylene compounds were dissolved in 600 ml of concentrated sulfuric acid. After the thus obtained solution had been filtered using a glass filter, it was dripped into 1200 ml of pure water and precipitated. The precipitate was filtered out and washed sufficiently by pure water and then dried. The thus obtained chemical compound is referred to as an acid paste treated product (AP product) the imidazole-perylene compounds.

Making the Photoreceptor 1

Polyamide resin CM-8000 (manufactured by Toray Co.), the weight of which was 30 g, was put into a solvent in which 900 ml of methanol and 100 ml of 1-butanol were mixed, and then heated and dissolved. This solution was coated on a conductive support in which a vapor-deposited layer of aluminum is provided on a polyethylene terephthalate film, the thickness of which was 100 μm. In this way, an intermediate layer of 0.5 μm thickness was formed.

Next, 6 g of polyvinyl butyral resin of Eslec BLS (Sekisui Kagaku Co.) was dissolved in 1000 ml of methylethlyketone, and further 28 g of AP products obtained in the above manner was mixed as the carrier generation material (CGM). After that, it was subjected to a sand mill (SG) for dispersion together with 2000 g of glass beads, the diameter of which was 1 mm. In this way, the dispersing solution 1 was obtained. The aforementioned intermediate layer was dip-coated with this solution, and a carrier generation layer (CGL) of 0.3 μm thickness was formed.

When the obtained dispersing solution was coated on a glass plate by a plurality of times and then dried, a dried solid film of about 200 μm thickness was made. This film was subjected to the measurement of X-ray diffraction spectrum using CuKα-rays. The result of the measurement of the obtained crystal was as follows. Peaks were formed when Bragg angles (2θ) were 6.3°±0.2°, 12.4°±0.2°, 25.3°±0.2°, and 27.1±0.2°. The peak intensity at the angle of 12.4°±0.2° was maximum, and the peak width at half height was 0.86°, and a peak was not present at 11.5°±0.2°.

Next, as a carrier transportation material, 150 g of the exemplary chemical compound T-1 and 200 g of polycarbonate resin of Yupiron Z-200 (manufactured by Mitsubishi Gas Kagaku Co.) were dissolved in 1000 ml of 1,2-dichloroethane. The obtained solution was coated in CGL described above and dried for 1 hour at 100° C. In this way, a carrier transportation layer (CTL) of 20 μm thickness was formed.

Figure 6:
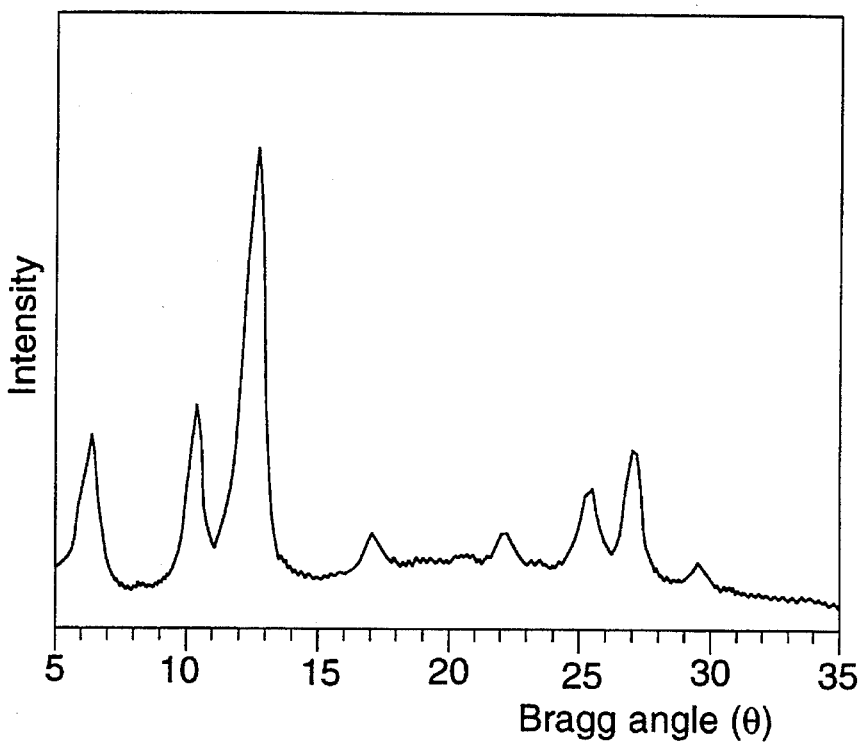
FIG. 6 is an X-ray diffraction spectrum of the imidazole-perylene pigment included in the present invention.

In the manner described above, the photoreceptor 1 shown on Table 2 having CGL and CTL on the intermediate layer was provided, wherein the photoreceptor 1 was used in Example 1 and Comparative Example 3. In this connection, the X-ray diffraction spectrum (XRD) is shown in FIG. 6 when the above dispersing solution 1 was used.

Preparing the Photoreceptor 2

Instead of the film having a vapor-deposited aluminum film to be used as a conductive base body of the photoreceptor 1, an aluminum drum was used as shown on Table 2, and other points were the same as those described before. In this way, the photoreceptor 2 shown on Table 2 was obtained. In this case, the photoreceptor 2 was used in Example 2 and Comparative Example 4.

Preparing the Photoreceptor 3

Instead of the solvent of methylethylketone in the aforementioned dispersing solution 1, 1,2-dichloroethane was used, and an amount of glass beads used in a sand mill for dispersion was set at 2500 g, and dispersion was effected for 20 hours, so that a solution 2 was obtained. Using the thus obtained dispersing solution 2, the same aluminum drum as that of the photoreceptor 2 was coated with the solution so as to form CGL.

In the same manner as the photoreceptor 1, the X-ray diffraction spectrum of the dispersing solution 2 was measured. As a result of the measurement, the following were found. As illustrated on Table 1, the peak intensity was maximum at the angle of 12.4°±0.2°, and the peak width at half height at this peak was 0.94°, and no peak was present at the angle of 11.5°±0.2°.

The exemplary chemical compound T-2 was used for CTM provided on CGL. Other points were the same as those of the photoreceptor 2. Under the above condition, CTL was formed, and the photoreceptor 3 shown on Table 2 was obtained, wherein the photoreceptor 3 was used in Example 3.

Preparing the Photoreceptor 4

Instead of the solvent of 1,2-dichloroethane in the aforementioned dispersing solution 2, tetrahydrofuran was used, and an amount of glass beads used in a sand mill for dispersion was set at 1500 g, and dispersion was effected for 10 hours, so that a solution 3 was obtained. Using the thus obtained dispersing solution 3, the same photoreceptor as the photoreceptor 3 was coated with the solution 3, and the photoreceptor 4 shown on Table 2 was obtained, wherein the photoreceptor 4 was used in Example 4.

In the same manner as the photoreceptor 1, the X-ray diffraction spectrum of the dispersing solution 3 was measured. As a result of the measurement, the following were found. As illustrated on Table 1, the peak intensity was maximum at the angle of 12.4°±0.2°, and the peak width at half height at this peak was 0.68°, and no peak was present at the angle of 11.5°±0.2°.

Preparing the Photoreceptor 5

Instead of the sand mill which was a dispersing means for dispersing the dispersing solution 1, a method of ultrasonic dispersion (US) was employed and the solution was dispersed for 5 hours. While other points were the same as those of the dispersing solution 1, the dispersing solution 4 was provided. The thus obtained solution was coated on an aluminum drum, and other points were the same as those of the photoreceptor 1. In this way, the photoreceptor 5 shown in Table 2 was provided, wherein the photoreceptor 5 was used in Comparative Example 1.

In the same manner as that of the photoreceptor 1, the X-ray diffraction spectrum of the above dispersing solution 4 was measured. As a result of the measurement, the maximum peak intensity was shown at an angle of 12.4°±0.2° as shown on Table 1. The peak width at half height of this peak was 0.60°, and a peak was present at an angle of 11.5°±0.2°.

Preparing the Photoreceptor 6

Instead of the AP products of the imidazole-perylene compounds of the dispersing solution 1, a sublimate of the imidazole-perylene compounds, that is, a SUB product was used, and other points were the same as those of the dispersing solution 1, so that the dispersing solution 1 was obtained. This dispersing solution was coated on an aluminum drum, and other points were the same as those of the photoreceptor 1. In this way, the photoreceptor 6 described on Table 2 were obtained, wherein the photoreceptor 6 was used for Comparative Example 2.

In the same manner as that of the photoreceptor 1, the X-ray diffraction spectrum of the above dispersing solution 5 was measured. As a result of the measurement, the maximum peak intensity was not shown at an angle of 12.4°±0.2° as shown on Table 1, but the maximum peak intensity was shown at an angle of 27.1°±0.2°, and the peak width at half height was 0.68°, and further no peak was present at an angle of 11.5°± 0.2°. In this case, the X-ray diffraction spectrum (XRD) is shown in FIG. 7.

TABLE 1

Figure 7:
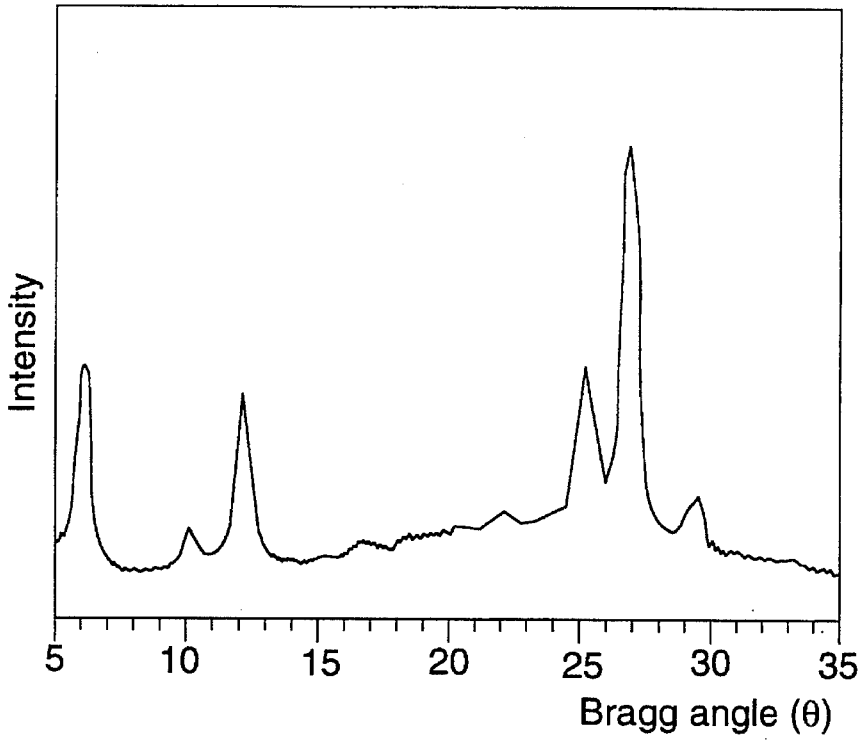
FIG. 7 is an X-ray diffraction spectrum of the imidazole-perylene pigment not included in the present invention.

| Dispersing solution | | CGM crystal form characteristics | | | CGM dispersing condition | | |
|---|---|---|---|---|---|---|---|
| No. | XRD | 11.5° peak | Maximum peak | Peak width at half height (12.40) | Charge | Solvent | Dispersion |
| 1 | FIG. 6 | (No) | (12.4°) | (0.86°) | Exemplary chemical compound Product AP of (A-1) | Methylethylketone | Amount of SG beads 2000 g Dispersed for 15 Hrs |
| 2 | | (No) | (12.4°) | (0.94°) | Exemplary chemical compound Product AP of (A-1) | 1,2-dichloroethane | Amount of SG beads 2500 g Dispersed for 20 Hrs |
| 3 | | (No) | (12.4°) | (0.68°) | Exemplary chemical compound Product AP of (A-1) | Terahydrofuran | Amount of SG beads 1500 g Dispersed for 10 Hrs |
| 4 | | (Yes) | (12.4°) | (0.60°) | Exemplary chemical compound Product AP of (A-1) | Methylethylketone | US Dispersed for 5 Hrs |
| 5 | FIG. 7 | (No) | (27.1°) | (0.68°) | Exemplary chemical compound subproduct of (A-1) | Methylethylketone | Amount of SG beads 2000 g Dispersed for 15 Hrs |

TABLE 2

| Photoreceptor No. | Dispersing solution No. | CTM | Conductive support |
|---|---|---|---|
| 1 (used for Example 1 and Comparative Example 3) | 1 | T-1 | Film of aluminum vapor-deposition |
| 2 (used for Example 2 and Comparative Example 4) | 1 | T-1 | Drum made of aluminum |
| 3 (used for Example 3) | 2 | T-2 | Drum made of aluminum |
| 4 (used for Example 4) | 3 | T-2 | Drum made of aluminum |
| 5 (used for Comparative Example 1) | 4 | T-1 | Drum made of aluminum |

TABLE 2-continued

| Photoreceptor No. | Dispersing solution No. | CTM | Conductive support |
|---|---|---|---|
| 6 (used for Comparative Example 2) | 5 | T-1 | Drum made of aluminum |

The photoreceptors described above were assembled to an apparatus in which exposure is carried out in accordance with the exposure system and time shown on Table 3. Characters $V_b$, $V_w$ and $V_r$ on the table are defined as follows.

$V_b$: Surface potential with respect to a document, the density of which is 1.3.

$V_w$: Surface potential with respect to a document, the density of which is 0.0.

$V_r$: Potential after discharge (Residual potential)

TABLE 3

| Embodiment | Photoreceptor No. | Exposure system | Expsore time | Initial potential Vb | Vw | Vr | CPM |
|---|---|---|---|---|---|---|---|
| Example 1 | Photoreceptor 1 | Flash exposure | $1.2 \times 10^{-4}$ | −751 | −76 | −18 | 125 |
| Example 2 | Photoreceptor 2 | Slit exposure | $1.8 \times 10^{-2}$ | −760 | −68 | −20 | 70 |
| Example 3 | Photoreceptor 3 | Slit exposure | $8.4 \times 10^{-3}$ | −758 | −72 | −14 | 80 |
| Example 4 | Photoreceptor 4 | Slit exposure | $4.4 \times 10^{-3}$ | −753 | −75 | −20 | 90 |
| Example 5 | Photoreceptor 2 | Slit exposure | $2.2 \times 10^{-2}$ | −760 | −50 | −18 | 50 |
| Comparative Example 1 | Photoreceptor 5 | Slit exposure | $8.4 \times 10^{-3}$ | −748 | −224 | −130 | 80 |
| Comparative Example 2 | Photoreceptor 6 | Slit exposure | $8.4 \times 10^{-3}$ | −754 | −238 | −148 | 80 |
| Comparative Example 3 | Photoreceptor 1 | Flash exposure | $9.2 \times 10^{-5}$ | −748 | −238 | −180 | 125 |
| Comparative Example 4 | Photoreceptor 2 | Slit exposure | $4.0 \times 10^{-2}$ | −760 | −45 | −12 | 30 |
| Comparative Example 5 | Photoreceptor 5 | Slit exposure | $4.0 \times 10^{-2}$ | −758 | −90 | −45 | 30 |

When the present invention is applied to a high speed copier of the flash or slit exposure type, it is possible to provide a sufficiently high potential gap between exposure and non-exposure portions. On the other hand, in Comparative Example 5 (photoreceptor 5), the potential in the exposure portion (Vw) was −90 V in the low-speed process. Although it was not necessarily sufficiently high, it was possible to form an image. However, in the high speed and short period exposure used in the high speed process shown in Comparative Example 1 (photoreceptor 5), the value of $V_w$ was high, and fog occurred on the image, so that the effect of the present invention was not sufficiently provided.

Example B

The photoreceptors made in Example A, were each set on a modified machine of U-Bix 3035 manufactured by Konica Corporation, and a repetition test was effected under the condition that the temperature was 40° C. and the relative humidity was 80%, wherein a process from charging to exposure and up to charge elimination was repeated by 100,000 times. The results of the test are shown on Table 4. On the table, $\Delta V_w$ shows a difference of potential at the initial stage, and $\Delta V_b$ shows a difference of potential after the repetition of 100,000 times. Further, toner, carrier and developer are prepared as follows.

Preparation of toner:

100 parts of styrene-acrylic resin (styrene-methyl methacrylate-butyl acrylate copolymer=75:15:10), 10 parts of carbon black and 3 parts of polypropylene having a number average molecular weight of 2,500 were mixed up, kneaded, pulverized and then, classified so as to obtain colored particles having a volume average particle-size of 9.8 μm. Further, 0.4 parts of hydrophobic silica (Aerosil R-972) is added to the colored particles, and toner could be obtained.

Preparation of carrier:

Preparation of carrier:

On ferrite particle having a volume average particle size of 80 μm, a copolymer having a composition of styrene/2,2,2-trifluoromethyl methacrylate was added so as to have a coated layer, and the carrier could be obtained.

Preparation of developer:

5 parts of the above-given toner and 95 parts of the above-given carrier were mixed, so that the developer for practical testing use were prepared.

TABLE 4

| | | AO agent is not added | | Addition of AO agent - Case 1 | | | Addition of AO agent - Case 2 | | |
|---|---|---|---|---|---|---|---|---|---|
| | | \|ΔVb\| | \|ΔVw\| | AO agent | \|ΔVb\| | \|ΔVw\| | AO agent | \|ΔVb\| | \|ΔVw\| |
| Photoreceptor 1 | Flash exposure $1.2 \times 10^{-4}$ | 30 V | 100 V | A-3 | 10 | 25 | A-22 | 20 | 50 |
| | | | | A-7 | 12 | 30 | A-24 | 25 | 65 |
| | | | | A-14* | 13 | 45 | | | |
| Photoreceptor 2 | Slit exposure $1.8 \times 10^{-2}$ | 6 V | 60 V | A-3 | 2 | 19 | A-22 | 6 | 35 |
| | | | | A-2 | 3 | 23 | A-24 | 5 | 40 |
| | | | | A-7 | 2 | 20 | | | |
| | | | | A-16 | 3 | 22 | | | |
| | | | | A-17 | 2 | 20 | | | |
| | | | | A-14* | 5 | 29 | | | |
| Photoreceptor 3 | Slit exposure $8.4 \times 10^{-3}$ | 30 V | 65 V | A-3 | 15 | 20 | A-22 | | 35 |
| | | | | A-7 | 12 | 22 | A-24 | | 40 |
| Photoreceptor 4 | Slit exposure $4.4 \times 10^{-2}$ | 10 V | 70 V | A-3 | 6 | 22 | A-22 | | 35 |
| | | | | A-19 | 8 | 25 | A-24 | | 45 |
| Photoreceptor 2 | Slit exposure $2.2 \times 10^{-2}$ | 6 V | 55 V | A-3 | 6 | 13 | A-22 | | 25 |
| | | | | A-7 | 6 | 15 | A-24 | | 30 |
| Comparative Example 1 Photoreceptor 5 | Slit exposure $8.4 \times 10^{-3}$ | 24 V | 120 V | A-3 | 12 | 60 | A-22 | 18 | 85 |
| | | | | A-17 | 20 | 65 | A-24 | 20 | 95 |
| Comparative Example 2 Photoreceptor 6 | Slit exposure $8.4 \times 10^{-3}$ | 10 V | 160 V | A-3 | 8 | 70 | A-22 | 10 | 90 |
| | | | | A-7 | 10 | 80 | A-24 | 10 | 110 |
| Comparative Example 3 Photoreceptor 5 | Slit exposure $4 \times 10^{-2}$ | 20 V | 70 V | A-3 | 15 | 24 | A-22 | 16 | 35 |
| | | | | A-7 | 13 | 28 | A-24 | 14 | 40 |
| Comparative Example 4 Photoreceptor 2 | Slit exposure $4 \times 10^{-2}$ | 4 V | 40 V | A-3 | 4 | 12 | A-22 | 4 | 20 |
| | | | | A-16 | 4 | 15 | A-24 | 4 | 29 |
| Comparative Example 5 Photoreceptor 2 | Flash exposure $9.2 \times 10^{-5}$ | 50 V | 150 V | A-3 | 40 | 60 | A-22 | 40 | 80 |
| | | | | A-7 | 45 | 65 | A-24 | 40 | 100 |

(Remarks)

In Case-1 in which AO agent was added, a multifunctional AO agent, which is a chemical compound containing not less than 2 groups of hindered phenol or hindered amine, was added.

In Case-2 in which AO agent was added, a monofunctional AO agent, which is a chemical compound containing one group of hindered phenol or hindered amine, was added.

Then 10 weight % of AO agent with respect to CTM added to CTL was added.

A-14* was added to the CGL layer, wherein a 5 weight % of A-14* with respect to CGM was added.

In the experiment, the exposure intensity was adjusted so that (Exposure amount)=(Exposure time)×(Intensity) could be constant.

The following effects were provided by Example B.

Compared with the comparative photoreceptors 5 and 6, according to the photoreceptors 1 to 4 of the present invention, even when the test was repeated under the condition that the exposure time was $1\times10^{-4}$ to $3\times10^{-2}$ seconds, increases of $V_b$ and $V_w$ were small. When the AO agent was added, an increase of the potential was suppressed. Especially, the multi-functional AO agent in which not less than 2 groups of hindered phenol or hindered amine are contained in one molecule is capable of providing excellent effects to suppress an increase of the potential. In the photoreceptors 1, 2, the AO agent A-14* was added to CGL, and the effect of the AO agent was provided. On the other hand, in the cases of the photoreceptors 5, 6, an increase of the surface potential was recognized in the repetition test, and even when the AO agent was added, a sufficiently high effect was not provided. When consideration was given to the exposure time, when the exposure time was less than $1\times10^{-4}$ sec, the potential was increased even in the case of the photoreceptor of the present invention (Comparative Example 5). When the exposure time was more than $3\times10^{-2}$ sec, even in the case of the comparative photoreceptor, an increase of the potential was in an allowable range. Due to the foregoing, it can be found that the reciprocity characteristic of the comparative photoreceptor is inferior so that the comparative photoreceptor can be used only for a low speed apparatus.

What is claimed is:

1. An image forming method using an electrophotographic photoreceptor comprising the steps of:

(1) charging the electrophotographic photoreceptor, wherein said electrophotographic photoreceptor comprising a conductive support and provided thereon, a carrier generation layer and a carrier transportation layer, said carrier generation layer comprising a carrier generation material which is formula 1 or 2 and having X-ray diffraction pattern having peaks at 6.3°±0.2°, 12.4°±0.2°, 25.3°±0.2° and 27.1°±0.2° in Bragg angle (2θ) when using Cu-Kα ray as a X-ray radiation source in which said peak of 12.4°±0.2° has a maximum intensity and has a half width of 0.65° or more; no peak being present at 11.5°±0.2°, (2) imagewise exposing the charged photoreceptor for an exposure time of $1\times10^{-4}$ to $3\times10^{-2}$ seconds, (3) developing the imagewise exposed photoreceptor to form an image, and (4) transferring the formed image to an image receiving material:

formula 1

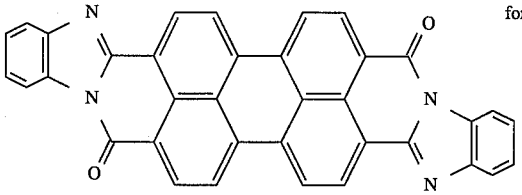

-continued formula 2

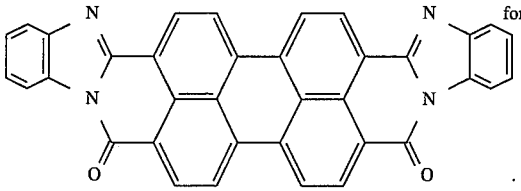

2. The image forming method of claim 1, wherein said exposure time is $1\times10^{-4}$ to $2\times10^{-2}$ seconds.

3. The image forming method of claim 1, wherein said electrophotographic photoreceptor comprises a hindered phenol compound having a hindered phenol moiety which is Formula 4 or Formula 5 or a hindered phenol compound having a hindered amine moiety which is Formula 6 or Formula 7:

Formula 4

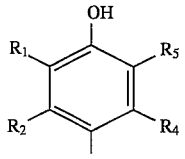

Formula 5

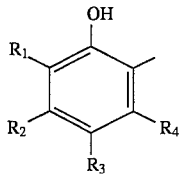

Formula 6

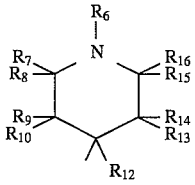

Formula 7

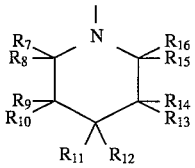

wherein $R_1$ and $R_7$ independently represents an alkyl group, $R_2$ through $R_6$ and $R_8$ through $R_{16}$ independently are a hydrogen atom, alkyl group, alkoxy group, aryl group, aralkyl group, acyl group, halogen group, nitro group, cyano group, amide group, and carbamoyl group.

4. The image forming method of claim 3, wherein said electrophotographic photoreceptor comprises a hindered phenol compound having at least two hindered phenol moieties which is said Formula 4 or said Formula 5 or hindered amine compound having at least two hindered amine moieties which is said Formula 6 or said Formula 7.

5. The image forming method of claim 1, wherein said electrophotographic photoreceptor comprises a compound having a hindered phenol moiety which is Formula 4 or Formula 5 and a hindered amine moiety which is Formula 6 or Formula 7:

Formula 4

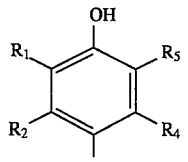

Formula 5

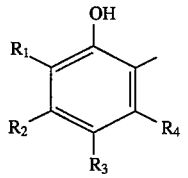

Formula 6

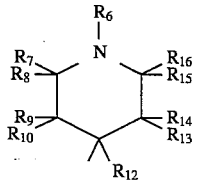

Formula 7

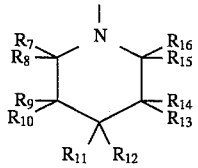

wherein $R_1$ and $R_7$ independently represents an alkyl group, $R_2$ through $R_6$ and $R_8$ through $R_{16}$ independently are a hydrogen atom, alkyl group, alkoxy group, aryl group, aralkyl group, acyl group, halogen group, nitro group, cyano group, amide group, and carbamoyl group.

6. The image forming method of claim 1, wherein said carrier transportation layer comprises a compound represented by Formula 3:

Formula 3

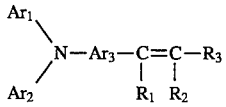

wherein, $Ar_1$ and $Ar_2$ independently are an aliphatic group or aromatic group, and $Ar_3$ represents a phenylene group, provided that $Ar_1$ and $Ar_3$ may form a ring; $R_1$ and $R_2$ independently are a hydrogen atom, an alkyl group or an aryl group; $R_3$ are an alkyl group or aryl group, provided that $R_2$ and $R_3$ may form a ring.

* * * * *